US007704012B2

(12) United States Patent
Lura

(10) Patent No.: US 7,704,012 B2
(45) Date of Patent: Apr. 27, 2010

(54) POWER ROLLER SCREED WITH MULTIPLE SCREED ROLLERS

(75) Inventor: Dennis K. Lura, Fargo, ND (US)

(73) Assignee: Lura Enterprises, Inc., West Fargo, ND (US)

( * ) Notice: Subject to any disclaimer, the term of this patent is extended or adjusted under 35 U.S.C. 154(b) by 0 days.

(21) Appl. No.: 12/468,162

(22) Filed: May 19, 2009

(65) Prior Publication Data

US 2009/0226258 A1 Sep. 10, 2009

Related U.S. Application Data

(60) Continuation of application No. 12/014,383, filed on Jan. 15, 2008, now Pat. No. 7,544,012, which is a division of application No. 11/299,064, filed on Dec. 9, 2005, now abandoned.

(51) Int. Cl.
*E01C 19/23* (2006.01)

(52) U.S. Cl. ..... 404/97; 404/118; 404/125; 404/131

(58) Field of Classification Search ..... 404/96, 404/97, 118, 120, 125, 126, 127, 128, 131, 404/132

See application file for complete search history.

(56) References Cited

U.S. PATENT DOCUMENTS

| | | | | | |
|---|---|---|---|---|---|
| 1,187,251 | A | * | 6/1916 | Bultman | 404/125 |
| 1,364,604 | A | | 1/1921 | Ashmore et al. | |
| 1,533,085 | A | | 4/1925 | Arnett | |
| 1,615,905 | A | * | 2/1927 | Hunt | 404/125 |
| 1,749,647 | A | * | 3/1930 | Poujaud | 404/132 |
| 1,794,696 | A | * | 3/1931 | Le Tourneau | 404/125 |
| 2,025,703 | A | | 12/1935 | Baily et al. | |
| 2,048,071 | A | | 7/1936 | Jacobson | |
| 2,245,865 | A | * | 6/1941 | Le Tourneau | 404/125 |
| 2,252,188 | A | | 8/1941 | Krehbiel | |
| 2,510,523 | A | | 6/1950 | Schiavi | |
| 3,119,313 | A | * | 1/1964 | Neidhardt et al. | 404/125 |
| 3,146,686 | A | * | 9/1964 | Grace et al. | 404/127 |
| 3,174,413 | A | | 3/1965 | Wittmack | |
| 3,515,043 | A | | 6/1970 | Austin | |
| 3,605,577 | A | | 9/1971 | Bik | |
| 3,605,582 | A | | 9/1971 | Kaltenegger | |
| 3,605,852 | A | | 9/1971 | Vecchiarelli | |

(Continued)

FOREIGN PATENT DOCUMENTS

| | | |
|---|---|---|
| CH | 673308 A5 | 2/1990 |

(Continued)

*Primary Examiner*—Gary S Hartmann
(74) *Attorney, Agent, or Firm*—Marsh Fischmann & Breyfogle LLP

(57) ABSTRACT

A rotating cylinder cement screeding system having a drive assembly and handle at one end for powering and controlling the screeding system. The rotating cylinder is made of tubular screed rollers of varying lengths allowing a user to customize the length of the system to match a specific cement pour. Further, each tubular screed roller is supplied with a male and female end for interlocking with each other and for receiving a variety of add on attachments. The rotating cylinder may also be equipped with a constant velocity type U-joint to allow the rotating cylinder to flex and thus, allow for pours with crowns or valleys, as need by the cement installer.

12 Claims, 18 Drawing Sheets

U.S. PATENT DOCUMENTS

| | | | | |
|---|---|---|---|---|
| 3,796,505 | A * | 3/1974 | Buhler | 404/132 |
| 3,801,211 | A | 4/1974 | Perkins | |
| 4,068,957 | A | 1/1978 | Brems et al. | |
| 4,142,815 | A | 3/1979 | Mitchell | |
| 4,340,351 | A | 7/1982 | Owens | |
| 4,702,640 | A | 10/1987 | Allen | |
| 5,062,738 | A | 11/1991 | Owens | |
| 5,190,401 | A | 3/1993 | Wilson | |
| 5,456,549 | A | 10/1995 | Paladeni | |
| 5,609,255 | A | 3/1997 | Nichols | |
| 5,664,908 | A | 9/1997 | Paladeni | |
| 5,803,656 | A | 9/1998 | Turck | |
| 6,119,788 | A * | 9/2000 | Bernier | 172/311 |
| D459,175 | S | 6/2002 | Monteil | |
| 6,402,425 | B1 | 6/2002 | Paladeni | |
| 6,457,903 | B1 * | 10/2002 | Dufty | 404/122 |
| 6,474,906 | B1 | 11/2002 | Cunningham et al. | |
| 6,503,558 | B2 | 1/2003 | Williamson | |
| 6,793,437 | B2 * | 9/2004 | Kitko et al. | 404/126 |
| 7,195,424 | B2 | 3/2007 | Lindley | |
| 7,544,012 | B2 * | 6/2009 | Lura | 404/118 |
| 2002/0025224 | A1 | 2/2002 | Williamson | |
| 2004/0131419 | A1 | 7/2004 | Hammond | |
| 2005/0158121 | A1 | 7/2005 | Lindley | |
| 2007/0134064 | A1 | 6/2007 | Lura | |
| 2009/0252554 | A1 * | 10/2009 | Lura | 404/119 |

FOREIGN PATENT DOCUMENTS

| | | | |
|---|---|---|---|
| EP | 0753626 | A1 | 1/1997 |
| WO | 97/07286 | A1 | 2/1997 |
| WO | 98/38384 | A | 9/1998 |
| WO | 03/031751 | A2 | 4/2003 |

* cited by examiner

FIG 8
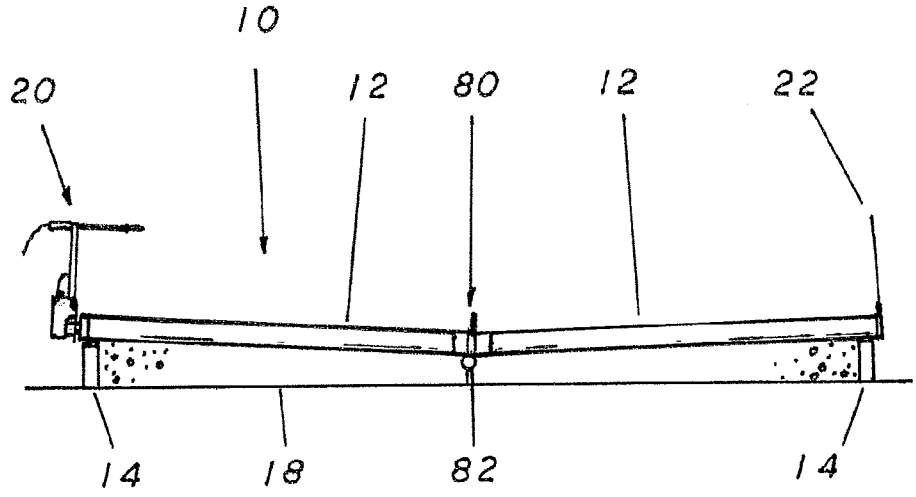
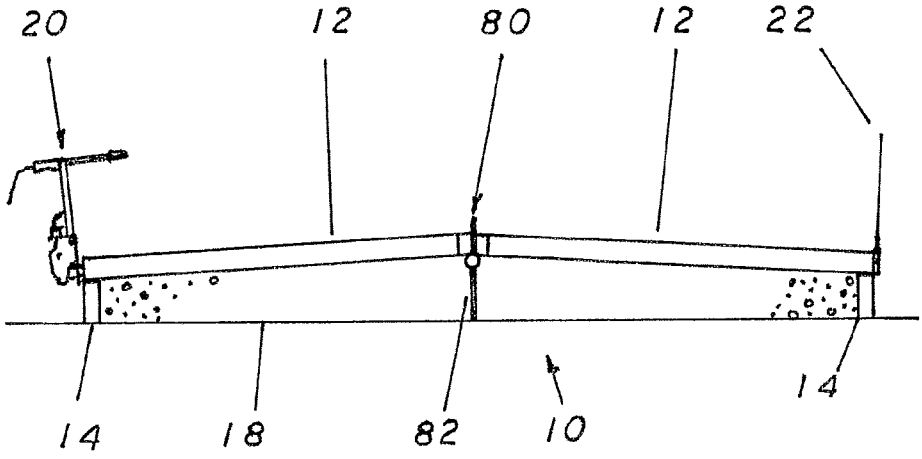
FIG 9

FIG 13
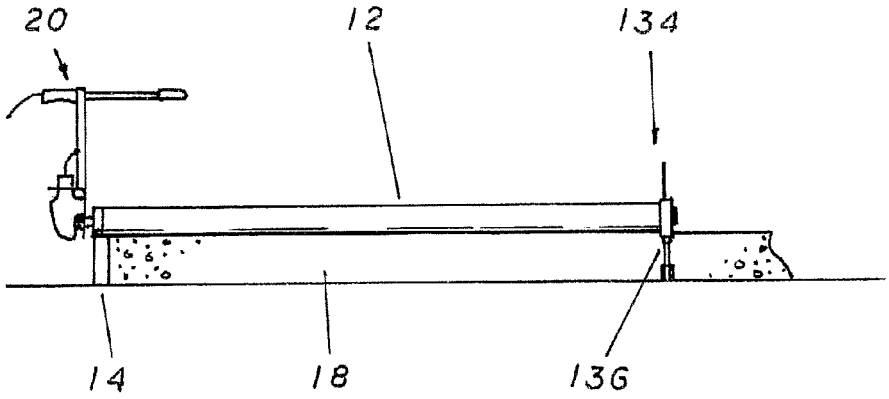
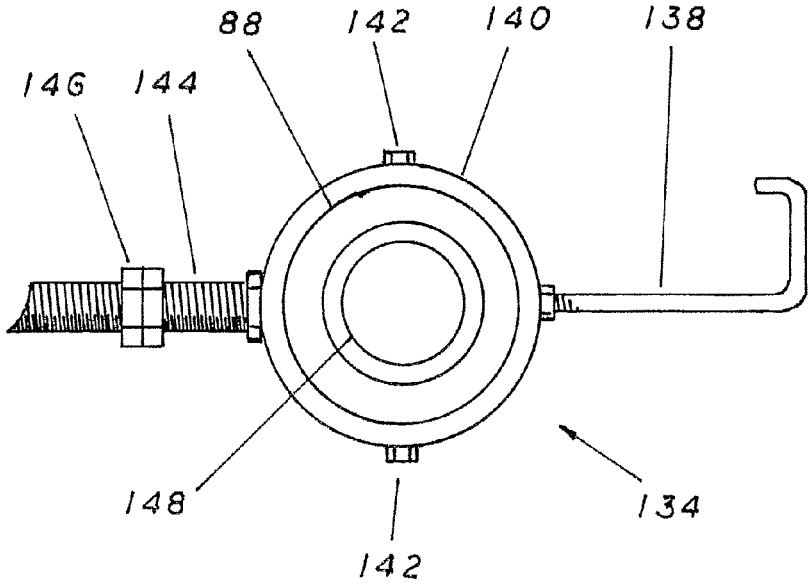
FIG 14

FIG 20
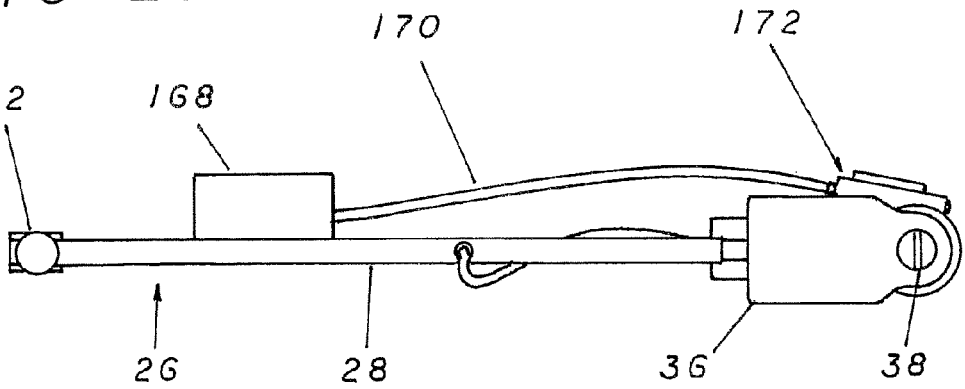
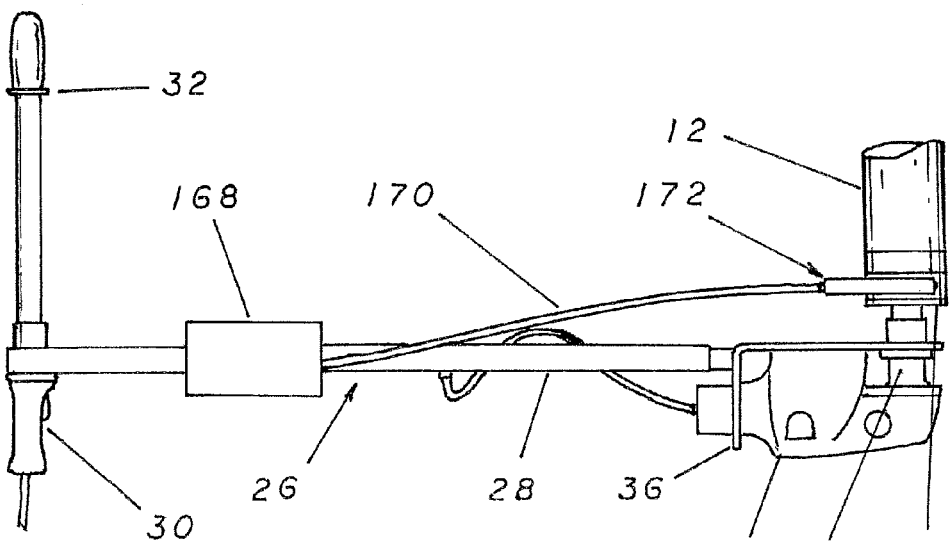
FIG 21

POWER ROLLER SCREED WITH MULTIPLE SCREED ROLLERS

CROSS-REFERENCE TO RELATED APPLICATIONS

This patent application is a continuation application of pending U.S. patent application Ser. No. 12/014,383, that is entitled "POWER ROLLER SCREED WITH MULTIPLE SCREED ROLLERS," and that was filed on Jan. 15, 2008, which is a divisional application of U.S. patent application Ser. No. 11/299,064, that is entitled "ARTICULATING REVERSIBLE POWER SCREED WITH A VARYING LENGTH ROLLER," and that was filed on Dec. 9, 2005 (now abandoned). Priority is claimed to each of these two patent applications, and the entire disclosure of each of these two patent applications is hereby incorporated by reference.

FIELD OF THE INVENTION

The present invention relates to an improvement in the methods used to level and finish freshly poured concrete slabs. More specifically, to a powered screed apparatus having an elongated cylindrical roller that is composed of connecting sections of varying length allowing for the use of the apparatus with concrete slabs of varying widths. Additionally, this screed apparatus contains components that enable it to be further adapted to be used with concrete slabs of differing shapes and profiles.

BACKGROUND OF THE INVENTION

Concrete slabs are ubiquitous in today's world. From highways to airport runways to parking lots to building floors, sidewalks, and driveways, concrete slabs form the durable surfaces we depend on for modem life. The methods used to construct all these differing structures are essentially the same in that they all require that the wet concrete mixture be poured into a form and a mechanism by which the concrete can be leveled and compacted.

In its simplest form, this process is accomplished by the use of wooden forms, most commonly 2 by 6 or 2 by 8 material, that is positioned in a parallel manner at the desired width. This form then operates to contain the poured concrete in a lateral area that is to be covered by the concrete slab. When the required amount of concrete is thus positioned, it is then necessary to level it off to the height of the forms. It is this later process in which the screed is employed. In this method the leveling process is accomplished by moving a flat piece of material spanning the two parallel forms in a back and forth manner. This operation serves to move any of the excess concrete that extends above the upper surfaces of the forms either into any low areas or off of the prospective slab altogether.

While the manual method described above works well enough on small jobs such as the repair of short sections of sidewalk, it has numerous deficiencies. The first of these is, that even in small jobs, it is labor intensive and therefore costly over the long term. Additionally, the use of a manual screed is not very effective at distributing and compacting the concrete within the form therefore producing a finished slab of a lesser quality than is generally desired. More importantly, the manual screed is effectively useless in larger jobs where wide slabs of concrete are required.

Many of the problems associated with the use of manual screeds have been solved by the use of powered models. The power screeds available today come in two general forms.

The first of these generally consist of a flat screed bar that is attached to a motorized articulation apparatus. In use, the screed bar fits over existing forms in much the same manner as the manually operated screed. The screed bar is then moved back and forth over the concrete by the articulation motor. While this system solves some of the problems associated with screeds, especially in larger jobs, it is cumbersome both in construction and operation.

The other type of powered screed is referred to as a powered roller screed. The powered roller screed generally consists of an elongated tube that is rotationally driven by an attached motor. In operation, the roller tube is positioned over the raw concrete at a position on the upper edges of the forms. The roller tube is then moved along the top of the forms in a direction that is opposite the rotational motion of the roller tube at its point of contact with the concrete. This apparatus produces a smooth and flat finish to the concrete and is generally considered to be the preferred method in the industry today.

While the powered roller screeds described above are effective, they do suffer from a number of operational deficiencies. The first of these is that they are designed and built in fixed lengths and are therefore not adjustable to accommodate concrete pours of varying widths. While this is not a huge problem, it results in the use of screed apparatuses that extend well over the forms making them difficult to maneuver at the job site.

Another problem with the powered roller screeds of the prior art is that they offer no way to compensate for special application concrete pours. It is often desirable to pour a concrete slab that either has a ridge or valley running longitudinally through its center. This form of concrete slabs is an effective way of controlling water with respect to the surface of the slab. The prior art consists entirely of screed apparatuses that have rigid rolling tubes. Therefore, in the past the only way of constructing ridges or valleys in concrete slabs was to pour each side of the slab independently. While this method works, it is more time consuming than it would be to perform the entire pour in one pass.

A further problem existing in the prior art is that they provide no reasonable means by which an extremely wide concrete pour can be accomplished as a single operation. This problem arises because the power sources are not powerful enough to drive long sections of screed roller tubes. A possible solution to this is to place a power unit on either side of the roller tube. For this approach to work, however, the power units must be capable of operating in opposite directions and their rate of rotation must be matched exactly. While possible, these requirements of such an apparatus make it impractical to build and operate such an apparatus.

A still further problem in the prior art is the inability of screed apparatuses to operate effectively in construction circumstances that require a circular concrete slab. Circular concrete slabs are commonly used in the construction of grain silos and other similar buildings. In the past the only way to finish these types of slabs was to run a screed apparatus over the pour from one end to the other or to manually rotate it around the pour. These methods work but produce results that are less than desirable.

From the forgoing discussion it can be seen that is would be desirable to provide a screed apparatus that is easily adjustable in the length of its roller thereby allowing it to be fitted to specific job applications. Additionally, it can be seen that it would be desirable to provide a screed apparatus that is capable of flexing to accommodate concrete pours containing ridges or valleys. It can also be seen that it would be desirable to provide a screed apparatus that is capable of operating in extremely wide concrete pours. Finally, it can be seen that it would be desirable to provide a screed apparatus that can be operated effectively in the finishing of circular concrete slabs.

SUMMARY OF THE INVENTION

It is the primary objective of the present invention to provide a powered roller screed apparatus that has the capacity of adjusting the length of the roller member to accommodate concrete pours of varying widths.

It is an additional objective of the present invention to provide such a powered roller screed apparatus that employs an articulating roller member allowing for its use with concrete pours having a ridge or valley extending down its longitudinal center.

It is a further objective of the present invention to provide such a powered roller screed apparatus that can employ the use of a roller member that has a center counter rotational assembly allowing for the use of two rotational drive motors on either end of the roller member thereby providing a means by which extremely wide concrete pours can be effectively accomplished.

It is a still further objective of the present invention to employ such a powered roller screed apparatus that can employ the use of a roller member that can be rotationally anchored at the center of a circular concrete pour thereby providing a means by which such slabs can be effectively finished.

These objectives are accomplished by the use of a powered rotational screed apparatus having a screed roller member that is adaptable to accommodate any number of specialized concrete slab pouring applications. The present invention is designed generally to facilitate the finishing process necessary in the formation of concrete slabs. In the accomplishment of this process, the present invention is deployed on a slab pour site in a manner so that its screed roller member comes into contact with both the upper surfaces of the concrete forms and the unfinished concrete contained therein. This is accomplished by extending the screed roller member between the forms and over the area where the slab is to be formed.

One end of the screed roller member is rotationally attached to the drive assembly and the other to a pull rope. The drive assembly is the component of the present invention that houses the drive motor which in turn provides the rotational power necessary to operate the present invention. The drive motor is fixed within the drive assembly by the use of the motor frame which also provides the point of fixed attachment of the handle assembly. The handle assembly extends upward from the motor frame to position the control handle and pulling handle in a location so that the entire drive assembly can be easily controlled by an operator. The other end of the screed roller member provides the point of attachment for the pull rope through the operation of a pull bearing. The pull bearing operates to isolate the pull rope from the rotational aspects of the screed roller member allowing it to be fixedly attached to the pull rope.

To perform the finishing operation, the drive motor is engaged which in turn powers the screed roller member. As the screed roller member spins, the drive assembly operator and the pull rope operator move the present invention in a direction that is opposite to the rotation of the screed roller member over the unfinished concrete. This action has been found to be effective in producing the desired finish on the upper surface of the slab while also causing the concrete to compact in the necessary consistency.

The drive assembly of the present invention is made up of a handle assembly that is attached at its proximal end to a drive motor frame. The drive motor frame houses the drive motor that provides the rotational force for the operation of the present invention. The handle assembly serves to position the control handle and the pull handle in a position so that they may easily be grasped and manipulated by the operator. Additionally, the control handle contains the switch that controls electrical power to the drive motor.

The output of the drive motor is configured so that it can be fitted to a drive socket which is of a common impact type. This in turn allows for the attachment of the drive plate assembly which in turn bolts to the proximal end of the screed roller member. The screed roller member is the elongated cylindrical component of the present invention that is used to perform the finishing operation that is the object of the present invention.

The screed roller member is made up of three primary components. The first of these is the tube body which is a tube of the desired inside and outside diameter and is generally composed of a high strength aluminum alloy. Aluminum is used in this application due to its desirable strength to weight ratio. The other components are the female and male attachment plugs. The female and male attachment plugs are relatively short cylindrical components having a shoulder of an identical outside diameter of the tube body and an engagement body that has an outside diameter that is equal to the inside diameter of the tube body. The screed roller member is formed by fixedly attaching one female and one male attachment plug to either end of the tube body.

The female and male attachment plugs also contain a threaded hole that passes longitudinally through their center. The threaded hole allows for the placement of a threaded rod in a position so that it extends out beyond the outside end of the male attachment plug to which it is fixedly attached. Additionally, the female attachment plug is designed with a recess that extends into its body at the initial segment of its threaded hole. Conversely, the male attachment plug is designed with a similarly positioned shoulder that fits within the recess of the female attachment plug. Thus, the threaded rod and the recess and shoulder components of the female and male attachment plugs provide a means by which two or more screed roller members can easily and securely connect to one another. Also, this design provides a means of attaching additional components that will be discussed in greater detail below.

The above described method of constructing the screed roller members provides a means by which the present invention can be adapted to match the width of all possible concrete pours. This is facilitated by the building of screed roller members of varying lengths that can then be quickly and easily added or removed to achieve the desired length. The operator then simply connects the desired screed roller members by the use of the threaded rod and threaded hole and secures them together by the use of a securement bolt which extends through the body of the female attachment plug and engages the threaded rod contained therein.

The present invention is also capable of being employed to finish a concrete slab that has either a ridge or valley running longitudinally though its center. This is accomplished by the use of the articulation member. The articulation member is a self-contained device that is designed to be fitted between two screed roller members. The placement of the articulation member in this manner allows the connected screed roller members to vary in their longitudinal axis with respect to one another thereby allowing the present invention to finish a concrete slab that contains either a central ridge or valley.

The articulation member contains two primary components that make this possible. The first of these is a centrally located U-joint that is fixedly attached at either end to the two joined screed roller members. The U-joint employed in this application is of a type that is commonly in automotive or other vehicle applications and allows the two screed roller members to rotate around slightly different longitudinal axises. The U-joint is located in a central cavity of the female and male articulation bodies which operate to tie the articulation member to the screed roller members.

The second component of the articulation member is the pull bearing assembly. The purpose of the pull bearing assembly is to provide an external surface within the screed roller member which is rotationally stationary when the bulk of the screed roller member is rotating during use. This is accomplished by the incorporation of an outer bearing body that is isolated from the remaining components by a bearing. The use of the pull bearing assembly in this application allows the articulation member to interact with a center support that is incorporated within the pour forms. The center support is positioned longitudinally within the form at the position where the center of the ridge or valley is to be located. The articulation member then runs along the top of the center support thereby finishing the concrete at the levels dictated by the forms and the center support.

An additional component provides the present invention with the capability of finishing wide concrete pours. This is the counter rotation member that, like the articulation member described above, fits between and connects two sections of screed roller members. The counter rotation member provides a means by which these two screed roller members can be rotated in opposite directions during finishing operations. This is necessary in wide pours because the drive motors normally employed in screeding concrete are not powerful enough to provide the rotational force to long sections of screed roller members. The use of the counter rotation member allows for the placement of an additional drive assembly in place of the pull rope thereby providing the power to finish wide concrete pours.

The counter rotation member is constructed in a similar manner as described above for the articulation member in that it contains a bearing that rotationally isolates an outer bearing body from the rotation of the screed roller members. Additionally, the counter rotation member also isolates the rotation of the two screed roller members attached to it from one another. This is accomplished by the internal structure of the counter rotation member in that its two primary components are the female and male counter rotation bodies. These two components serve to connect the counter rotation member to the screed roller members. Additionally, each of these is equipped with an inner flange which are rotationally isolated from one another by a pair of isolation bearings. This configuration provides the means by which the two screed roller members can rotate in opposite directions thereby allowing the present invention to finish wide concrete pours.

Another optional component of the present invention that adds flexibility to its operations is the center anchor member. The center anchor member allows the present invention to finish circular concrete pours such as those used in the construction of grain silos and other similar buildings. The center anchor member allows the non-powered end of the screed roller member to be properly anchored in the center of the concrete pour and to rotate freely therein.

The center anchor member is made up of a stationary outer ring that is fixedly attached at its lower end to an anchor rod and at its upper end to a handle. The anchor rod serves to provide the rotational attachment to the anchor tube that is positioned in the desired location with respect to the concrete slab.

The outer bearing ring also provides for the pivotal attachment of the bearing that allows for the attachment of the screed roller member that is accomplished by the use of an extending threaded rod and a centering securement nut. The pivotal nature of the attachment of the bearing also allows for the altering of the angle of attachment of the screed roller member providing a means by which an angled pour of the concrete can be accomplished for much the same reasons as described above for the articulating member.

A still further attachment for the present invention is provided that allows for the finishing of a concrete slab in a situation where it is desirable to construct a concrete slab adjacent to an existing one with an upper surface that is slightly lower than the existing one. This application is most common in the pouring of a driveway up to a garage slab. This attachment consists of an existing slab drop-down member that is attached to the non-powered end of a screed roller member. The existing slab drop-down member is attached in much the same manner as described above for other components of the present invention in that it contains an isolated bearing and an outer pull ring. This allows for the attachment of a pull rope on the non-powered end of the screed roller member that provides a means of controlling this end of the screed roller member.

Finally, the existing slab drop-down member has an extending drop-down body that has an outside diameter that is smaller than that of the screed roller member. This drop-down body allows for the finishing of a concrete slab that is lower than the existing slab thereby creating the desired relationship between the two concrete slabs.

A yet further attachment for the present invention is the footing member. The footing member provides the present invention with the capability of finishing a concrete slab that is used to form the floor of a basement where the footings and walls are already constructed. The footing member is made up of a footing member body that is attached to the non-powered end of a screed roller body in the same manner as described for the previous attachments using an outer bearing body and bearing configuration. Additionally, the footing member is equipped with a ring spacer. The ring spacer is a circular plate that is inserted into the footing member in a location so that it effectively raises the screed roller member up off of the footing. This design allows for the simplified pouring of such a concrete slab up to the wall and over the footing to properly construct a basement floor.

The final attachment for the present invention in terms of this discussion is the vibration compacting member. The vibration compacting member operates to enhance the present invention's concrete compacting effect of the unfinished concrete slab. This is accomplished by the employment of a device that is commonly used in the concrete industry known as a stinger. The stinger is made up of a vibrating rod that is inserted into wet concrete and which drives out air pockets contained within the concrete.

In its use with the present invention, the stinger's vibration drive motor is attached to the drive assembly. The vibration drive motor has a flexible drive rod that extends from it down to the stinger body positioned at the drive end of the screed roller member between the drive plate assembly and the screed body. The attachment of the vibration compacting body to the screed roller member is accomplished by the use of an outer bearing body and stinger bearing assembly in a similar manner as described above for the present invention's previously illustrated attachments.

The stinger body is made up of a stinger tube and a stinger ring. The stinger body contains the stinger and transfers its vibrational motion to the stinger ring. The stinger ring is in turn attached to the stinger bearing assembly that transfers the vibration to the screed roller member. This design serves to impart a vibrational aspect to the motion of the screed roller member during the finishing operation. This vibration has been found to enhance the compacting of the unfinished concrete as it operates to drive off unwanted the air pockets that are inherent in all concrete pours.

For a better understanding of the present invention reference should be made to the drawings and the description in which there are illustrated and described preferred embodiments of the present invention.

BRIEF DESCRIPTION OF THE DRAWINGS

FIG. 8 is a front elevation view of the present invention illustrating its use in conjunction with the articulation member to finish a concrete slab having a valley running longitudinally through its center.

FIG. 9 is a front elevation view of the present invention as configured in FIG. 8 illustrating it as used to finish a concrete slab having a ridge running longitudinally through its center.

FIG. 13 is a front elevation view of the present invention illustrating its use in conjunction with the center anchor member to finish a circular concrete slab.

FIG. 14 is a front elevation view of the center anchor component of the present invention illustrating its manner of construction.

FIG. 20 is a side elevation view of the drive assembly component of the present invention illustrating it as used in conjunction with a vibrational compacting member.

FIG. 21 is a top elevation view of the drive assembly of FIG. 20.

DETAILED DESCRIPTION

Figure 1:
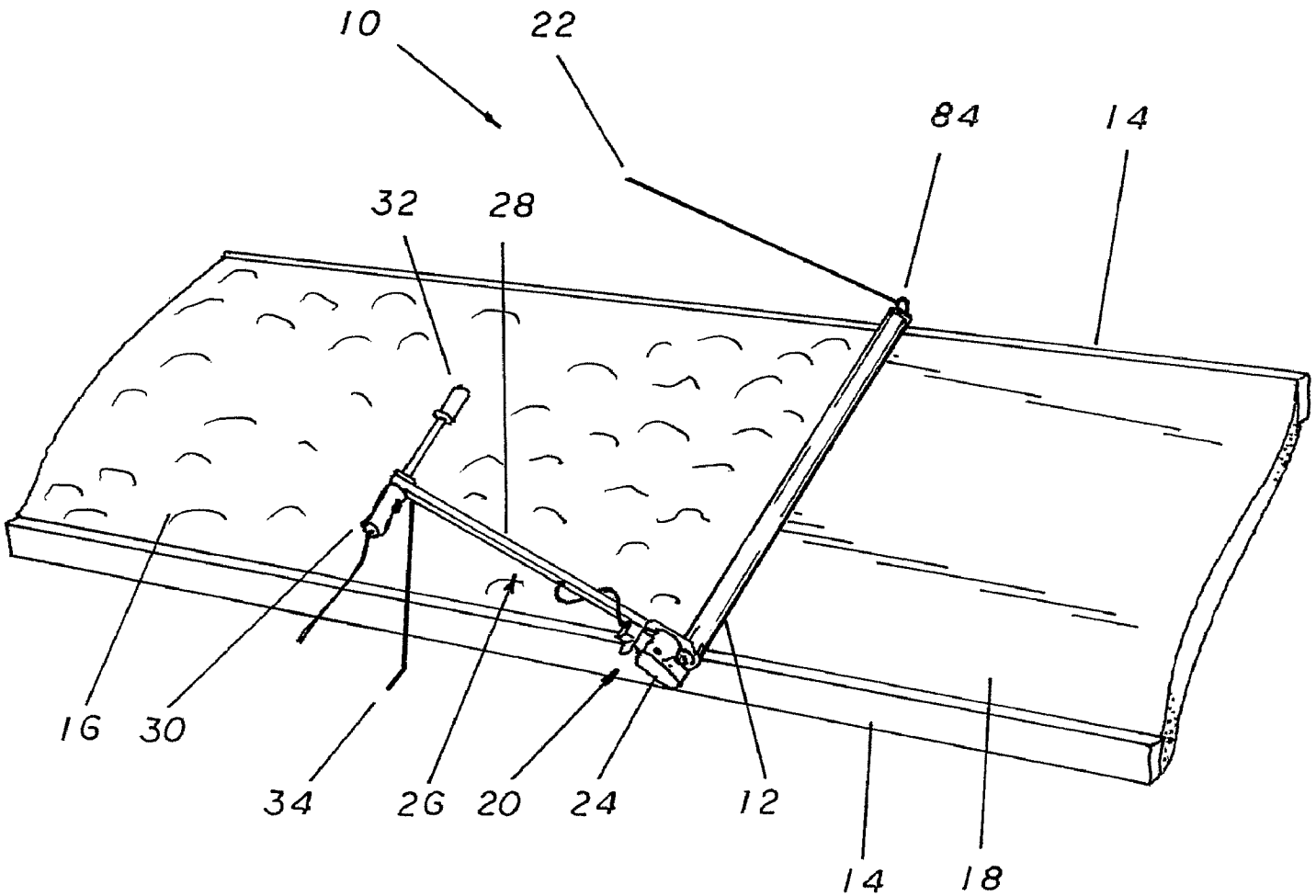
FIG. 1 is a perspective view of the present invention which illustrates the manner in which it is deployed to finished a slab of concrete.
Figure 2:
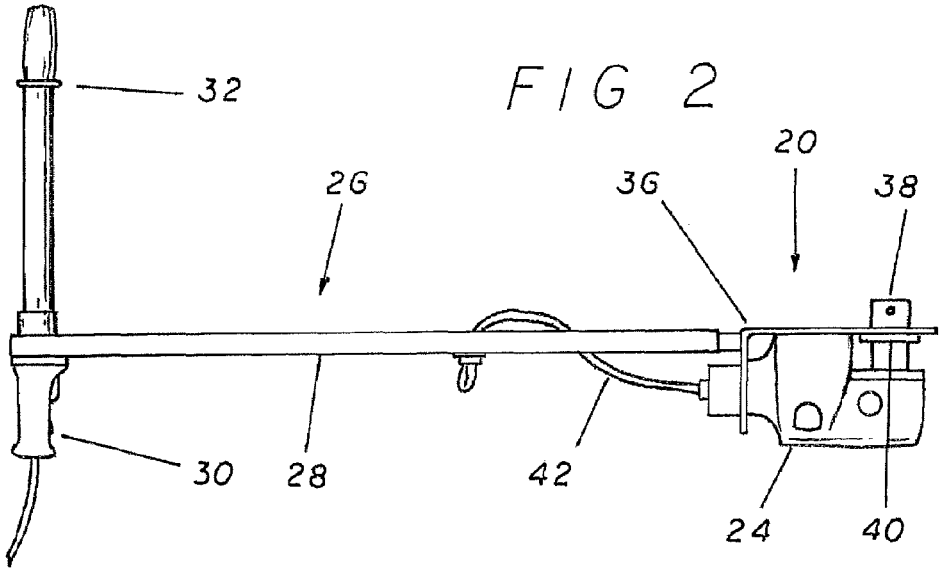
FIG. 2 is a top elevation view of the drive assembly component of the present invention illustrating its manner of construction.
Figure 3:
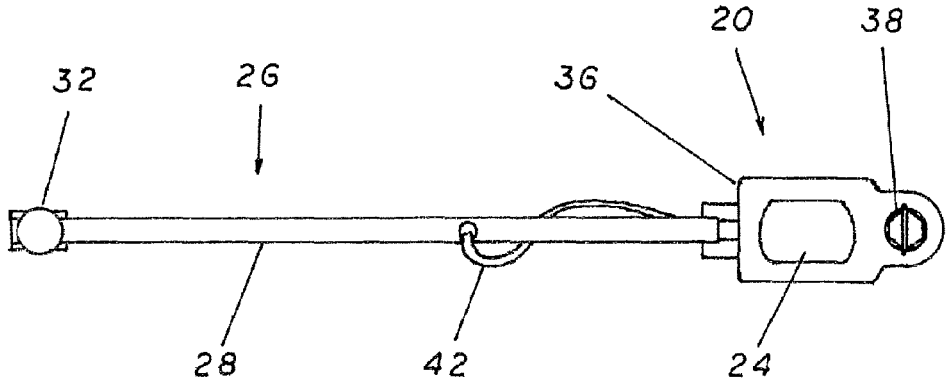
FIG. 3 is a side elevation view of the drive assembly component of FIG. 2.

Referring now to the drawings, and more specifically to FIGS. 1, 2, and 3, the powered rotational screed apparatus 10 has a screed roller member 12 that is adaptable to accommodate any number of specialized concrete slab pouring applications. The present invention is designed generally to facilitate the finishing process necessary in the formation of concrete slabs. In the accomplishment of this process, the present invention is deployed on a slab pour site in a manner so that its screed roller member 12 comes into contact with both the upper surfaces of the concrete forms 14 and the unfinished concrete 16 contained therein. This is accomplished by placing the screed roller member 12 between the concrete forms 14 and over the area where the slab is to be formed.

One end of the screed roller member 12 is rotationally attached to the drive assembly 20 and the other to a pull rope 22. The drive assembly 20 is the component of the present invention that houses the drive motor 24 which in turn provides the rotational power necessary to operate the present invention. The drive motor 24 is fixed within the drive assembly 20 by the use of the motor frame 36 which also provides the point of fixed attachment for the handle assembly 26. The handle assembly 26 extends upward through the extension bar 28 from the motor frame 36 to position the control handle 30 and the pull handle 32 in a position so that the entire handle assembly 26 can be easily controlled by an operator. Finally, the power to the drive motor 24 is supplied through the power cord 42 by way of the control handle 30. The drive motor 24 may also be powered by an appropriate battery (not shown) which may be mounted to the drive motor 24 or extension bar 28.

The other end, or the non-powered end, of the screed roller member 12 provides the point of attachment for the pull rope 22 through the operation of a pull bearing assembly 84. The pull bearing 84 operates to isolate the pull rope 22 from the rotational aspects of the screed roller member 12 allowing it to be fixedly attached to the pull rope 22. The nature and manner of operation of the pull bearing 84 will be described in greater detail below with reference to other components of the present invention.

Additionally, the handle assembly 26 of the present invention is equipped with a pivotally mounted stand 34. The stand 34 allows the drive assembly 20 to be left in an upright position when not in use so that the control and pull handles, 30 and 32, are in an easily accessible location. When not in use, the pivotal attachment of the stand 34 allows it to be rotated up next to the extension bar 28 so that it is not in the way during the operation of the handle assembly 26.

To perform the finishing operation, the drive motor 24 is engaged by the use of the control handle 30 which in turn powers the screed roller member 12. As the screed roller member 12 spins, the drive assembly 20 operator and the pull rope 22 operator move the present invention in a direction that is opposite to the rotation of the screed roller member 12 over the unfinished concrete 16. This action has been found to be effective in producing the desired finish on the upper surface of the finished concrete 18 while also causing the concrete to compact to the necessary consistency.

Figure 4:
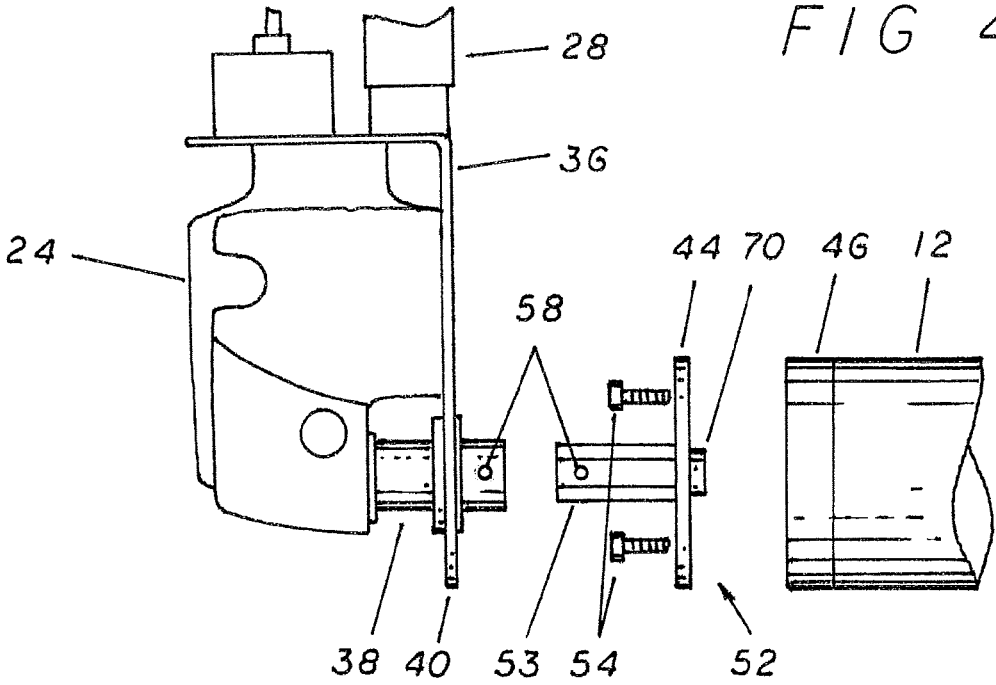
FIG. 4 is a side elevation exploded view of the drive motor and drive plate assembly components of the present invention illustrating the manner by which they engage the screed roller member.

The output of the drive motor 24 is configured so that it can be fitted to a drive socket 38 which is of a common 6 point impact type as illustrated in FIG. 4. As the drive socket 38 passes through the motor frame 36, it is encased by the socket bearing 40. The socket bearing 40 allows the drive socket 38 to spin freely with the drive motor 24 while securely holding it within the stationary motor frame 36.

The use of the drive socket 38 allows for the securement of the drive plate assembly 52 which in turn bolts to the proximal end of the screed roller member 12. To facilitate this, the drive plate assembly 52 is equipped with a rearwardly extending hexagonal shaft 53 that is specifically designed to engage the internal surface of the drive socket 38. Additionally, each of these components has an attachment pin hole 58. The attachment pin holes 58 allow for the passage of an attachment pin (not shown) through the drive socket 38 and hexagonal shaft 53 which secures the two together.

The drive plate assembly 52 also has a circular drive plate 44 that is of the same outside diameter as the screed roller member 12. The drive plate 44 allows for the attachment of the drive plate assembly 52 to the screed roller member 12 through the use of a plurality of bolts 54. Additionally, the distal surface of the drive plate 44 is equipped with a centrally located male shoulder 70 that operates to center the female attachment plug 46 of the screed roller member 12 with reference to the drive plate assembly 52. This configuration not only transfers the rotational power of the drive motor 24 to the screed roller member 12, but also ensures that all of the operational components are properly aligned.

Figure 5:
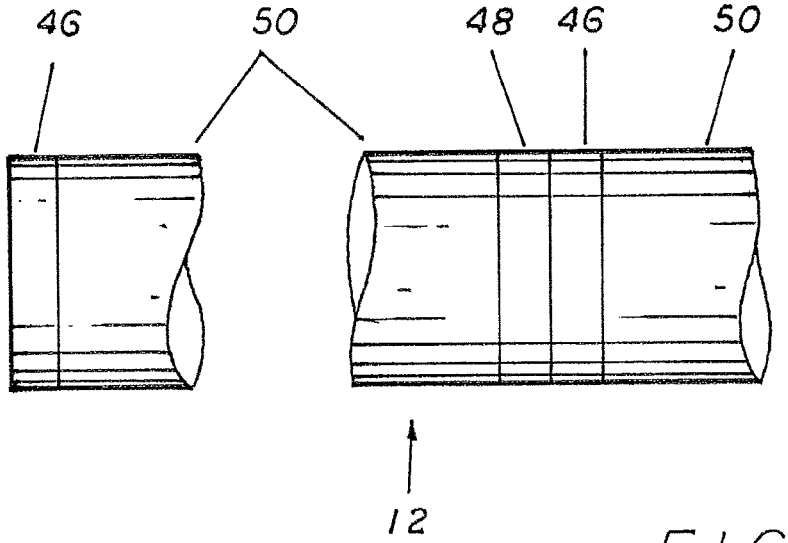
FIG. 5 is a side elevation view of the screed roller member of the present invention illustrating its general manner of construction and the way two or more can be joined together to form a longer screed roller member.
Figure 6:
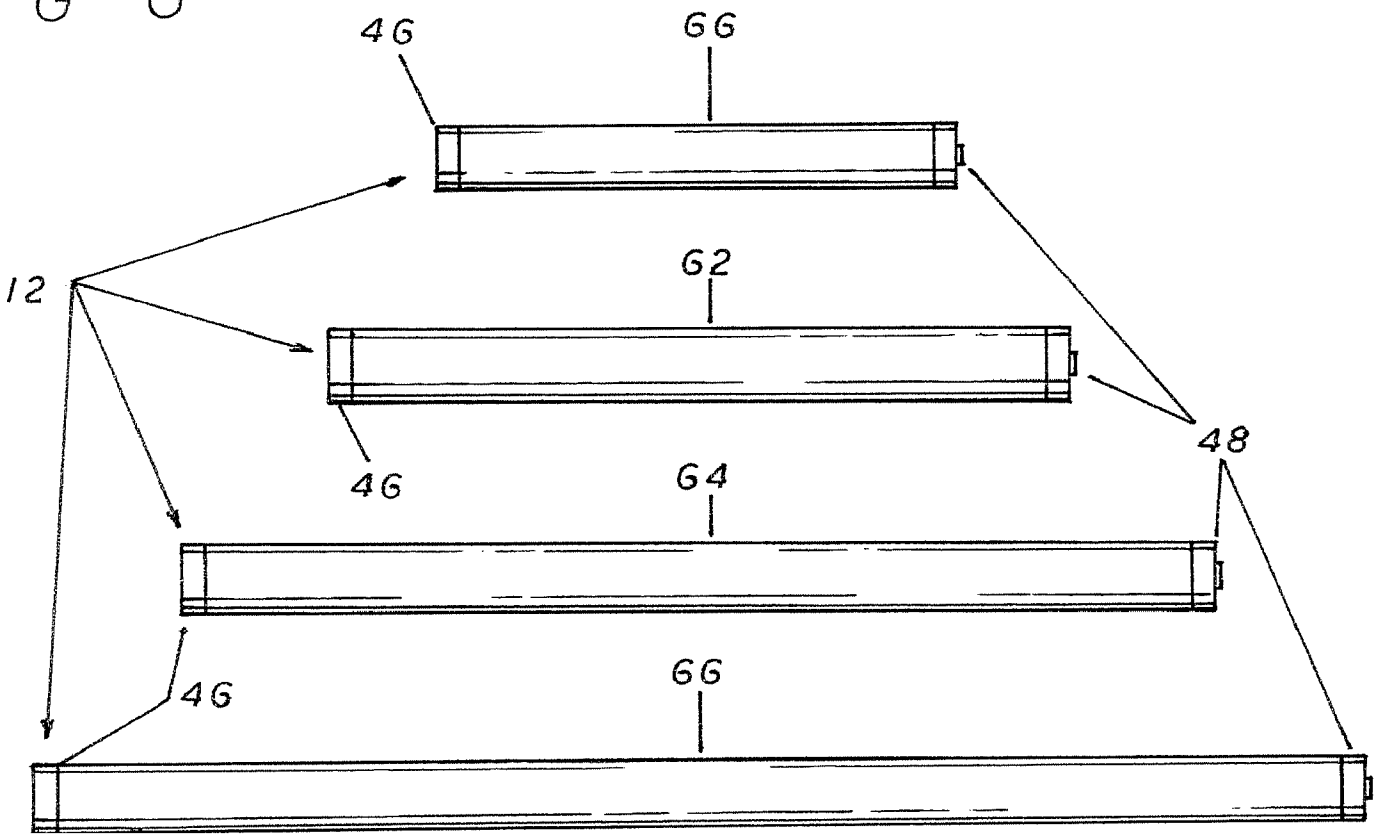
FIG. 6 is a side elevation view of a plurality of screed roller members illustrating the varying lengths in which they can be constructed.

The screed roller member 12 is the elongated cylindrical component of the present invention that performs the finishing operation that is the object of the present invention. The external manner of construction of the screed roller member 12 is illustrated in FIGS. 5 and 6. The screed roller member 12 is made up of three primary components. The first of these is the tube body 50 which is a tube of the desired inside and outside diameter and is generally composed of a high strength aluminum alloy, although the use of other materials for this purpose is possible. Aluminum is used in this application due to its desirable strength to weight ratio. The other components are the female and male attachment plugs, 46 and 48.

The female and male attachment plugs, 46 and 48, are relatively short cylindrical components having a shoulder of an identical outside diameter of the tube body 50 and an engagement body that has an outside diameter that is equal to the inside diameter of the tube body 50. The screed roller member 12 is formed by fixedly attaching one female attachment plug 46 and one male attachment plug 48 to either end of the tube body 50. This forms a complete unit that is then capable of being used individually or in conjunction with another as will be described in greater detail below.

The above described method of constructing the screed roller members 12 provides a means by which the present invention can be adapted to match the width of all possible concrete pours. This is facilitated by the building of screed roller members 12 of varying lengths that can then be quickly and easily added or removed to achieve the desired length. This design allows for the construction of screed roller members 12 of varying lengths as illustrated by length A, B, C, and D screed roller members, 60, 62, 64, and 66. Additionally, it must be stated that the lengths of the screed roller members 12 as shown is intended to be for illustrative purposes only and the construction of a screed roller member of any usable length is possible.

Figure 7:
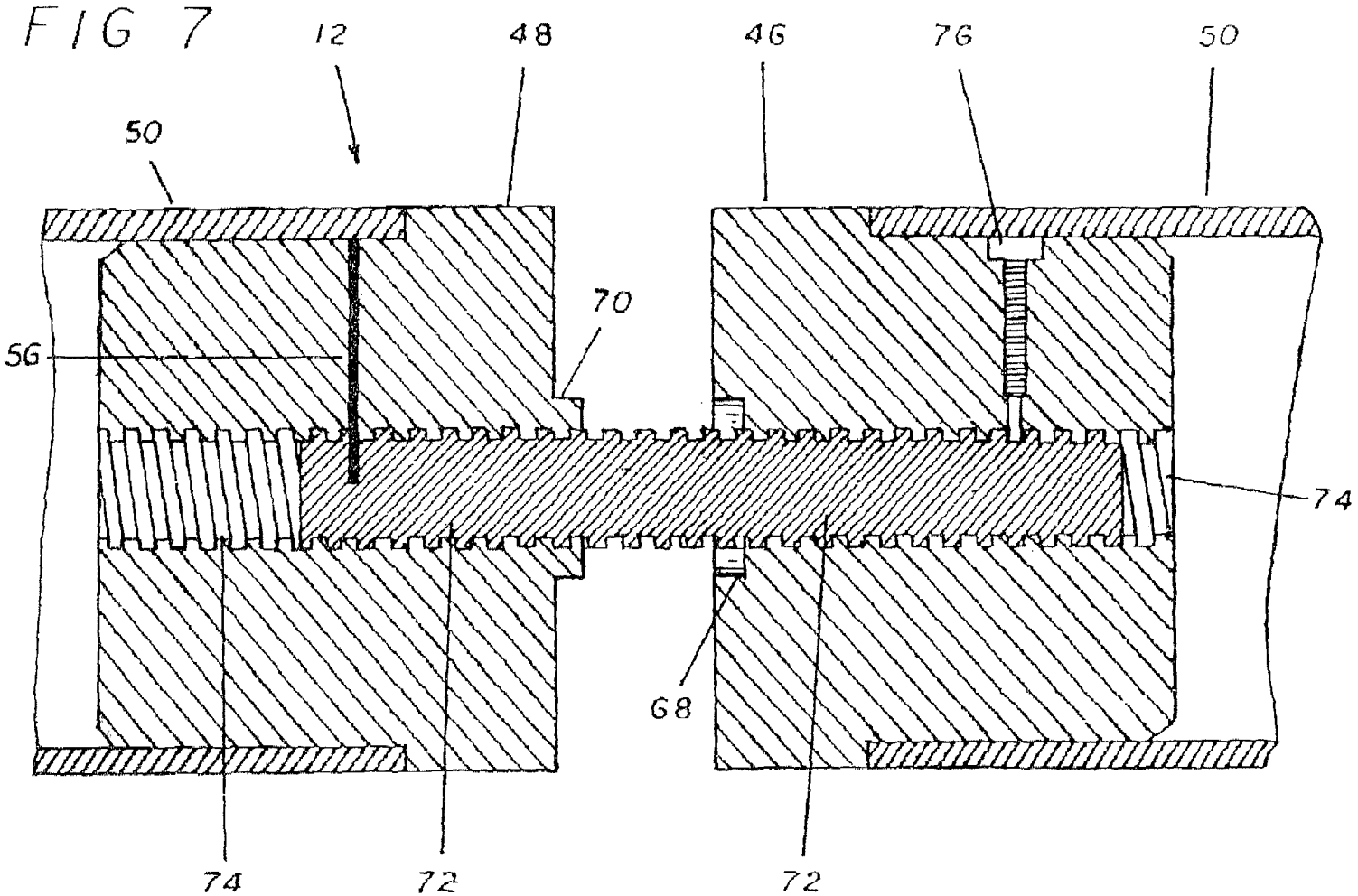
FIG. 7 is a side elevation cut-away view of the connection between two adjoining screed roller members illustrating the methods employed to make the connection.

The female and male attachment plugs, 46 and 48, also contain a threaded hole 74 that passes longitudinally through their center as illustrated in FIG. 7. The threaded hole allows 74 for the placement of a threaded rod 72 in a position so that it extends out beyond the outside end of the male attachment plug 48 to which it is fixedly attached. This attachment is accomplished by passing an attachment pin 56 through the body of the male attachment plug 48 in a manner so that it engages the threaded rod 72. In this configuration, the attachment pin 56 is retained within the male attachment plug 48 even when the screed roller member 12 is disassembled.

The female attachment plug 46 is designed with a centrally located, with respect to its longitudinal axis, female recess 68 that extends into its body at the initial segment of its threaded hole 74. Conversely, the male attachment plug 48 is designed with a similarly positioned male shoulder 70 that fits within the female recess 68 of the female attachment plug 46. Thus, the threaded rod 72, the female recess 68, and the male shoulder 70 components of the female and male attachment plugs, 46 and 48, provide a means by which two or more screed roller members 12 can easily and securely connected to one another. Finally, once the proper connection has been accomplished through the described methods, the female attachment plug 46 can be locked in place with reference to the threaded rod 72. This is accomplished by the use of the securement bolt 76 that passes through the body of the female attachment plug 46 and engages the surface of the threaded rod 72.

The connection of two or more screed roller members 12 is then simply accomplished by connecting the desired screed roller members 12 by the use of the threaded rod 72 and threaded hole 74 and their associated components. Also, this design provides a means of attaching additional components that will be discussed in greater detail below.

Figure 10:
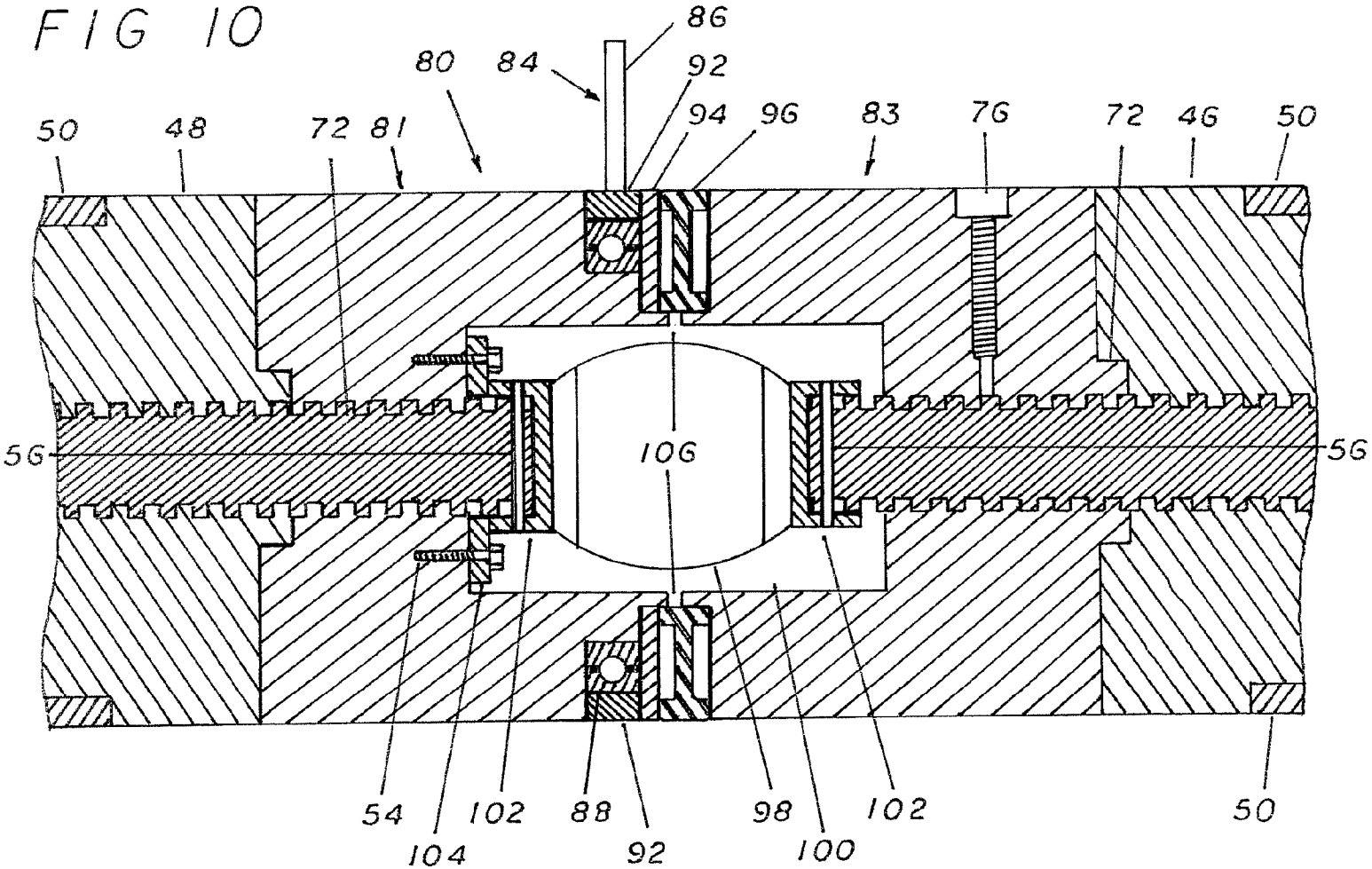
FIG. 10 is a side elevation cut-away view of the articulation member component of the present invention illustrating the manner of construction of its internal components.

The present invention is also capable of being employed to finish a concrete slab that has either a ridge or valley running longitudinally though its center as illustrated in FIGS. 8, 9, and 10. This is accomplished by the use of the articulation member 80. The articulation member 80 is a self-contained device that is designed to be fitted between two screed roller members 12. The placement of the articulation member 80 in this manner allows the connected screed roller members 12 to vary in their longitudinal axis with respect to one another thereby allowing the present invention to finish a concrete slab that contains either a central ridge or valley.

To accomplish this, a center support 82 is positioned in the desired location at the longitudinal center of the concrete forms 14. The articulation member 80 is then positioned between two or more screed roller members 12 in a location that it corresponds in its relative location to the center support. The articulation member 80 then rides along the top of the center support 82, the height of which relative to the concrete forms 14, determines the rise or drop in the finished concrete's 18 surface.

The articulation member 80 contains three primary components that make this possible. The first of these is a centrally located U-joint 98 that is fixedly attached at either end to the other two components, the female and male articulation bodies, 81 and 83. The U-joint 98 employed in this application is of a type that is commonly in automotive or other vehicle applications and allows the two screed roller members 12 to rotate around slightly different longitudinal axises.

The U-joint 98 is located in a centrally located U-joint cavity 100 of the female and male articulation bodies, 81 and 83, which operate to tie the articulation member 80 to the screed roller members 12. The attachment of the U-joint 98 to the female and male articulation bodies, 81 and 83, is accomplished through the use of the rod attachment cups 102. The rod attachment cups 102 are fixedly attached to the U-joint 98 on their inside end and fit over the end of the present threaded rod 72 on their outside. With the threaded rod 72 so positioned, an attachment pin 56 is passed through the rod attachment cups 102 and the associated threaded rods 72.

The rod attachment cup 102 that is associated with the female articulation body 81 is also fixedly attached to an attachment cup flange 104. The attachment cup flange 104 is then bolted to the inner surface of the female articulation body 81 by a plurality of bolts 54. This not only fixedly attaches the U-joint 98 to the female articulation body 81, but also serves to secure the female articulation body 81 to the associated male attachment plug 48 of the screed roller member 12. Conversely, the male articulation body 83 is secured not only by the operation of its associated threaded rod 72, but also by a securement bolt 76 that passes through it and engages the surface of the threaded rod 72.

An additional component of the articulation member 80 is the pull bearing assembly 84. The pull bearing assembly 84 is the same component of the present invention that is used on the non-powered end of a conventional screed roller member 12 that allows for the attachment of a pull rope 22 as described above. The purpose of the pull bearing assembly 84 is to provide an external surface within the screed roller member 12 which is rotationally stationary when the bulk of the screed roller member 12 is rotating during use. This is accomplished by the incorporation of an outer bearing body 90 that is isolated from the remaining components by a bearing 88. The bearing 88 fits within a bearing cavity 89 that is machined into the outer portion of the female articulation body 81. Finally, the outer bearing body 90 is also equipped with a pull ring 86 that allows for the attachment of an external rotationally stationary device to the screed roller member 12.

The articulating ability of the articulation member 80 is facilitated by the methods employed to construct the female and male articulation bodies, 81 and 83. The inner surfaces of these two components are manufactured flex gap 106 that provides room for them to longitudinally move in relation to one another. Additionally, the portion of the female and male articulation bodies, 81 and 83, that is outside of the flex gap 106 contains a seal cavity 96. The seal cavity 96 allows for the positioning of a seal 94 between the female and male articulation bodies, 81 and 83. The use of the seal 94 ensures that concrete or other debris cannot enter the U-joint cavity 100 and damage the U-joint 98 contained therein. Finally, the seal 94 is isolated from the bearing 88 by the use of an isolation ring 92.

Figure 11:
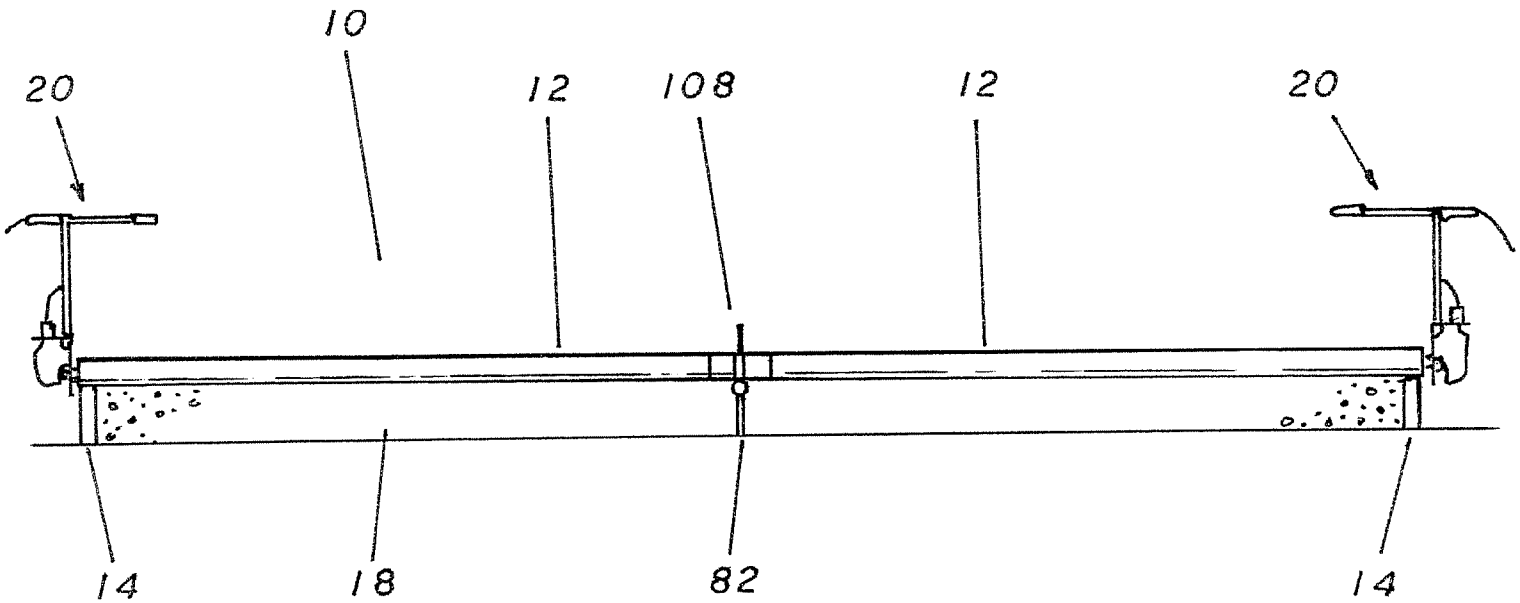
FIG. 11 is a front elevation view of the present invention illustrating its use in conjunction with the counter rotation member to finish a wider that normal concrete slab.
Figure 12:
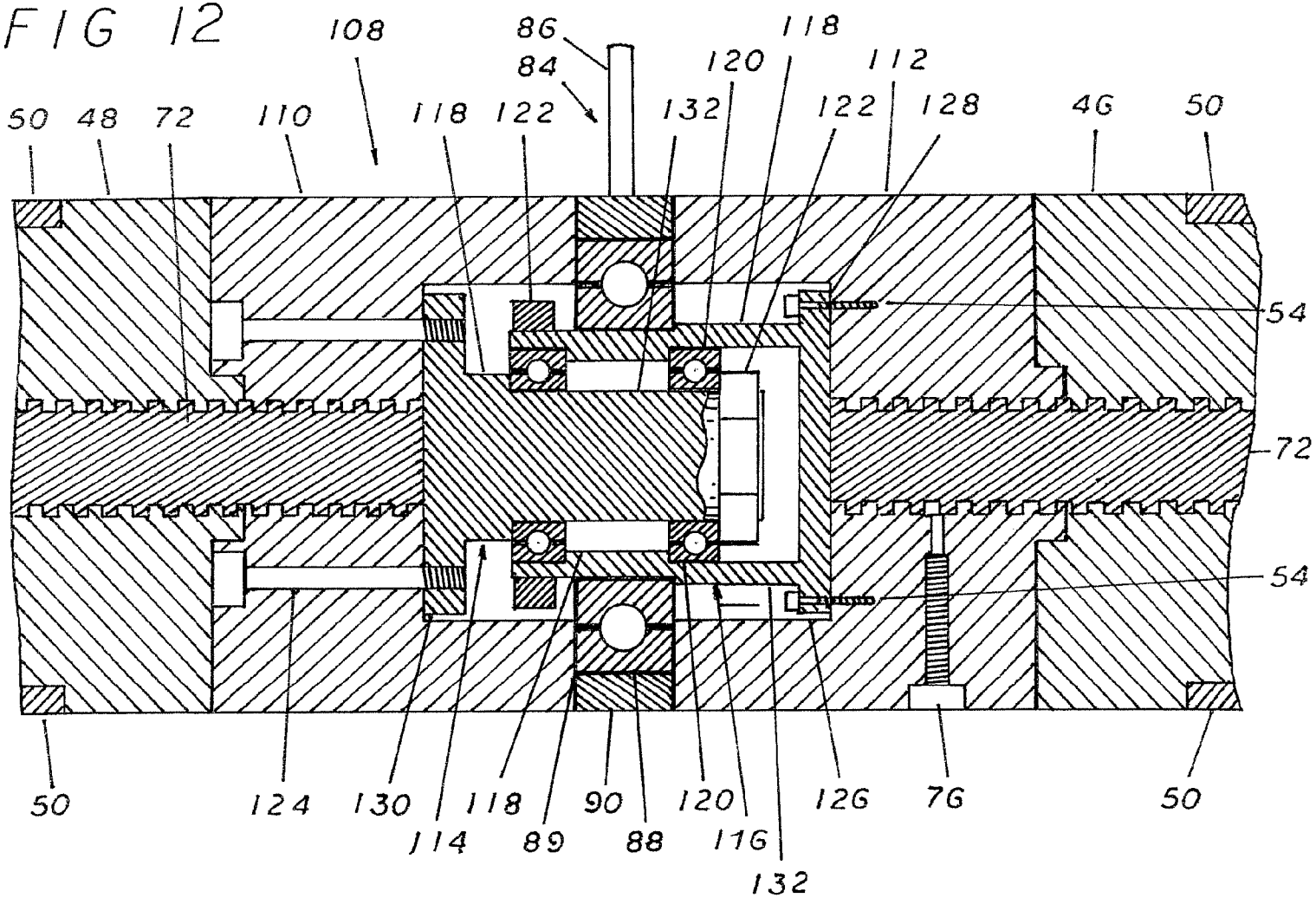
FIG. 12 is a side elevation cut-away view of the counter rotation member component of the present invention illustrating the manner of construction of its internal components.

An additional component provides the present invention with the capability of finishing wide concrete pours that is illustrated in FIGS. 11 and 12. This is the counter rotation member 108 that, like the articulation member 80 described above, fits between and connects two sections of screed roller members 12. Additionally, the use of the counter rotation member 108 employs the use of a center support 82 that functions in a similar manner as described above.

The counter rotation member 108 provides a means by which these two screed roller members 12 can be rotated in opposite directions during finishing operations. This is necessary in wide pours because the drive motors 24 normally employed in screeding concrete are not powerful enough to provide the rotational force to long sections of screed roller members 12. The use of the counter rotation member 108 allows for the placement of an additional drive assembly 20 in place of the pull rope 22 thereby providing the power to finish wide concrete pours.

The counter rotation member 108 is constructed in a similar manner as described above for the articulation member 80 in that it contains a bearing 88 positioned in a bearing cavity 89 that rotationally isolates an outer bearing body 90 from the rotation of the screed roller members 12. Additionally, the counter rotation member 108 also isolates the rotation of the two attached screed roller members 12 from one another. This is accomplished by the internal structure of the counter rotation member 108 in that its two primary components are the female and male counter rotation bodies, 110 and 112. These two components serve to connect the counter rotation member 108 to the screed roller members 12. Additionally, the female and male counter rotation bodies, 110 and 112, are tied together though the internal components of the counter rotation member 108 which in turn serves to connect the entire structure.

These internal components of the counter rotation member 108 consist primarily of two related components. The first of these is the female inner flange 114 that is attached to the female counter rotation body 110 through the use of the female counter rotation attachment flange 130 and a plurality of large bolts 124. The second is the male inner flange 116 connected to the male counter rotation body 112 through the use of a male counter rotation attachment flange 128 and a plurality of bolts 54. The female and male inner flanges, 114 and 116, are positioned within the counter rotation cavity 126 located within the female and male counter rotation bodies, 110 and 112.

The female and male inner flanges, 114 and 116, both extend from their connection to their respective component towards the center of the counter rotation cavity 126 in a manner so that the male inner flange 116 extends over approximately two thirds of the female inner flange 114. These components are configured so that there is a space left between the inner surface of the male inner flange 116 and the outer surface of the female inner flange 114. Additionally, the inner surface of the male inner flange 116 is equipped with a centrally positioned bearing spacer shoulder 118 and the female inner flange 114 has a corresponding bearing spacer shoulder 118 that is positioned so that an isolation bearing 120 can fit between it and the outer edge of the male inner flange's 116 bearing spacer shoulder 118. The opposite end of the male inner flange's 116 operates to position an additional isolation bearing 120.

The isolation bearings 120 serve to rotationally isolate the female and male inner flanges, 114 and 116, from one another. This is accomplished not only by their positioning within the gap between the female and male inner flanges, 114 and 116, but also by the nature of their connection to the female and male inner flanges, 114 and 116. This manner of construction allows the female inner flange 114 and all of the components of the present invention to which it is attached to rotate in one direction while the male inner flange 116 and all of the components to which it is attached to rotate in the other thereby providing the function that is central to the counter rotation member 108.

As stated above the female and male inner flanges, 114 and 116, also serve to tie the female and male counter rotation bodies, 110 and 112, together. This is accomplished by the use of securement nuts 122, one each of which is threaded over the ends of the female and male inner flanges, 114 and 116. The securement nut that is threaded over the open end of the female inner flange 114 tightens down on the corresponding isolation bearing 120. This serves to force this isolation bearing 120 against the bearing spacer shoulder 118 of the male inner flange 116 which in turn forces the other isolation bearing 120 against the female inner flange's 114 bearing spacer shoulder 118. Thus, the nature of the construction of these components of the present invention serves to rotationally tie the female and male inner flanges, 114 and 116, together by eliminating the possibility of lateral movement when assembled.

This rotational connection is also reinforced by the use of the second securement nut 122. When assembled, the second securement nut 122 is threaded over the open end of the male inner flange 116 and operates to force the pull bearing 88 against an additional bearing spacer shoulder 118 located on the outer surface of the male inner flange 116. This then further restricts any lateral movement of the male inner flange 116. Thus, the manner of construction of the counter rotation member 108 provides a means by which two connected screed roller members 12 can be rotated in opposite directions thereby allowing for the use of the present invention in the finishing of unusually wide concrete pours.

Figure 15:
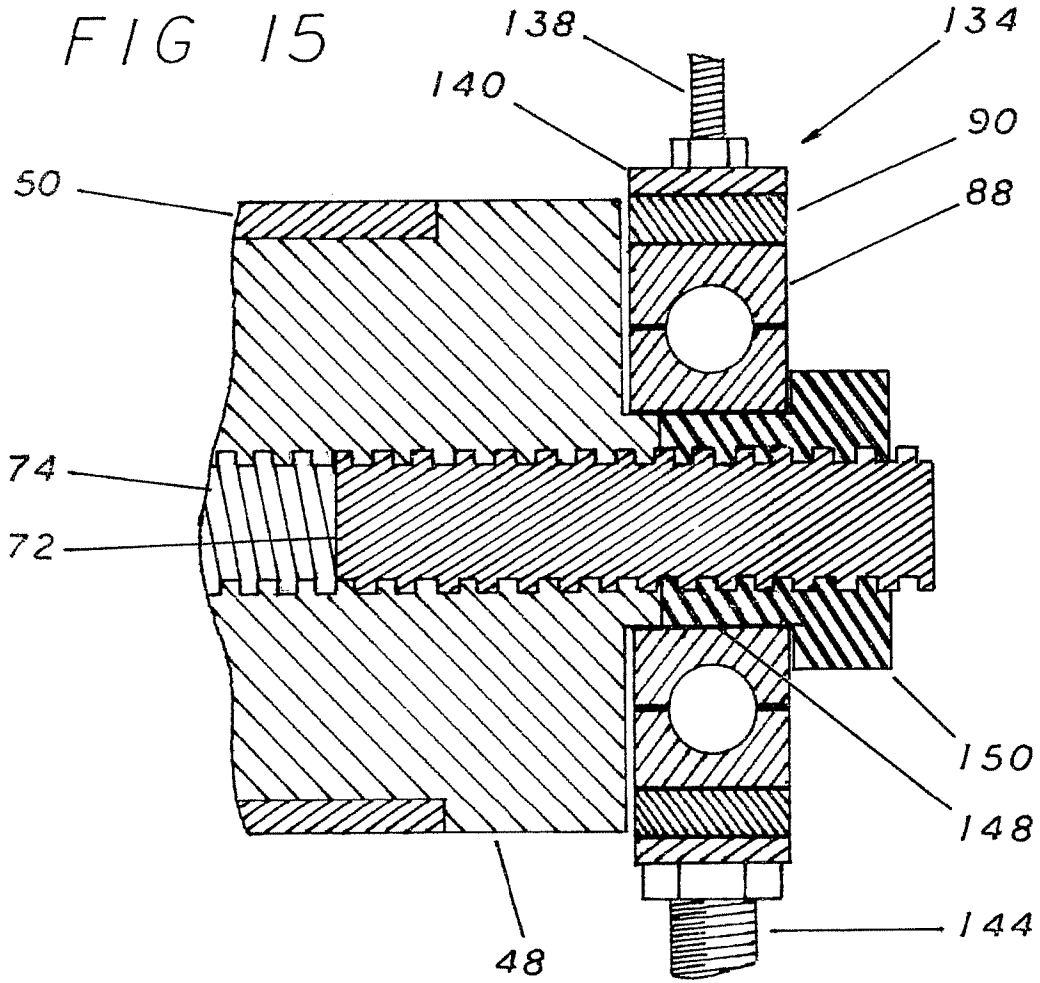
FIG. 15 is a side elevation cut-away view of the center anchor member component of the present invention illustrating the manner of construction of its internal components.

Another optional component of the present invention that adds flexibility to its operations is the center anchor member 134 and is illustrated in FIGS. 13, 14 and 15. The center anchor member 134 allows the present invention to finish a circular concrete pours such as those used in the construction of grain silos and other similar buildings. The center anchor member 134 provides a means by which the non-powered end of the screed roller member 12 may be properly anchored in the center of the concrete pour and rotate freely therein.

The center anchor member is made up of a stationary outer bearing ring 140 that is fixedly attached at its lower end to an anchor rod 144 and at its upper end to a handle 138. The anchor rod 144 serves to provide the rotational aspect to the center anchor member 134 through its positioning within the anchor tube 136 that is positioned in the underlying ground at the desired location with respect to the concrete slab. The anchor tube 136 is simply an open-ended vertically oriented section of tubing that the lower end of the anchor rod 144 slips into. This method of securing the anchor rod 144 allows it to freely rotate supplying the pivotal action that is required by the operation of the center anchor member 134. Additionally, the relative height of the anchor rod 144 in relation to the anchor tube 136 is controlled by the positioning of lock nuts 146 along the length of the anchor rod 144.

The outer bearing ring 140 of the center anchor member 134 also provides for the pivotal attachment of the bearing 88 which in turn allows for the attachment of the screed roller member 12. This attachment is accomplished by the use of a threaded rod 72 that is positioned so that it extends out beyond the end of the screed roller member 12 and the attached center anchor member 134. This then allows for the placement of a centering securement nut 150 that is threaded over this extending portion of the threaded rod 72. The centering securement nut 150 also contains a shoulder that, when installed, fills the gap between the threaded rod 72 and the center anchor member's 134 center attachment hole 148.

The pivotal nature of the attachment of the bearing 88 within the bearing ring 140 is accomplished by a plurality of pivotal attachment bolts 142. The pivotal attachment bolts 142 pass through the bearing ring 140 and into the outer bearing body 90 in a manner that allows pivotal motion of the outer bearing body 90 around the axis created by the pivotal attachment bolts 142. This manner of construction allows for the altering of the angle of operation of the screed roller member 12 with relation to the center anchor member 134 providing a means by which an angled pour of the concrete can be accomplished in much the same manner as the articulation member 80.

Figure 16:
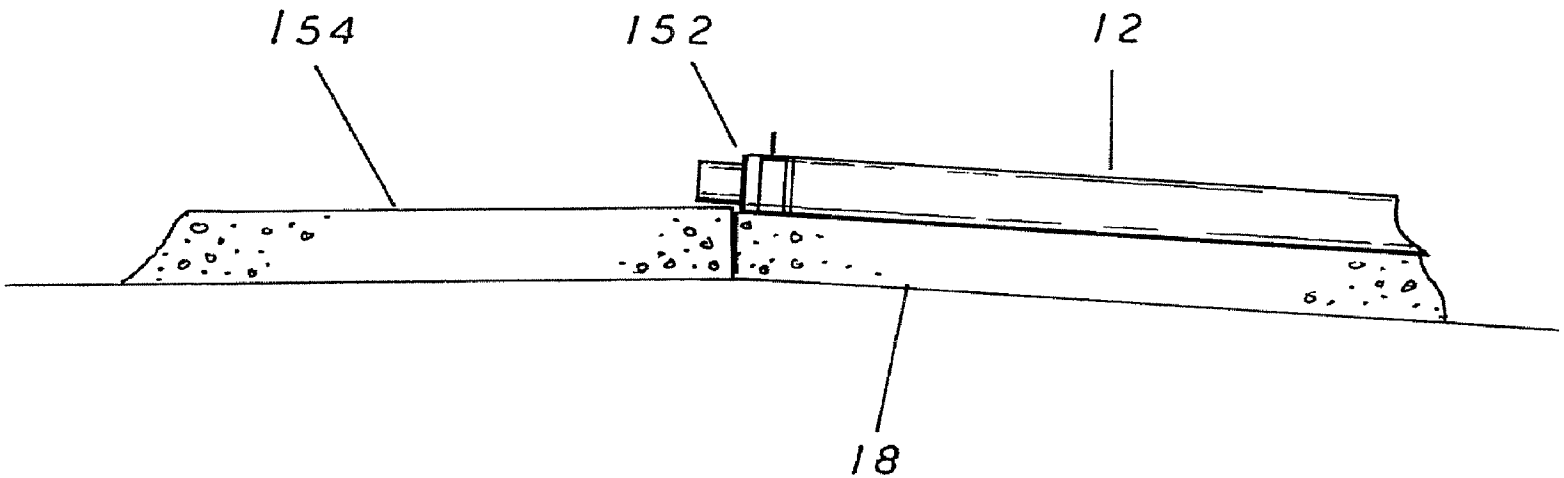
FIG. 16 is a front elevation view of the existing slab drop-down member component of the present invention illustrating its manner of construction.
Figure 17:
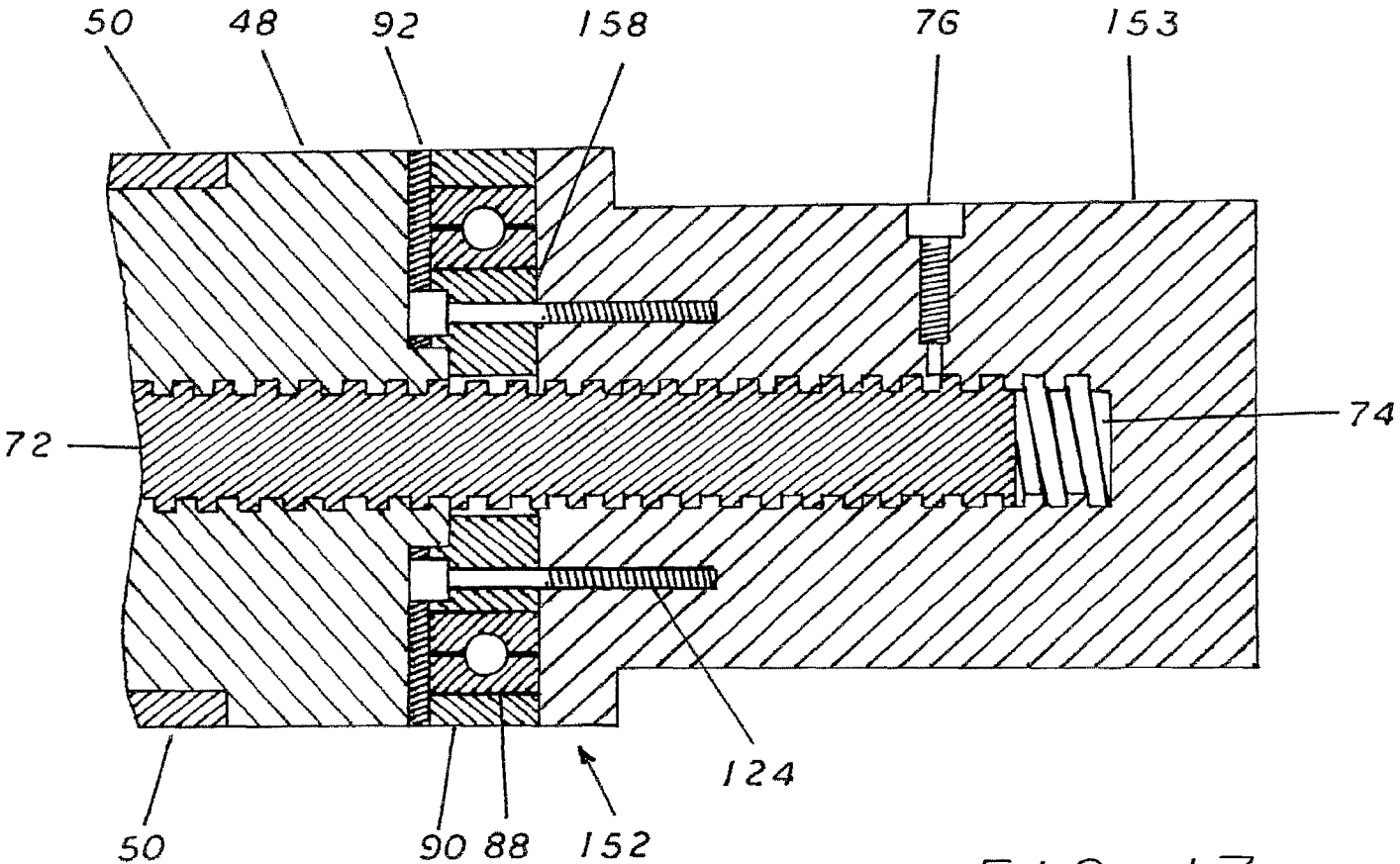
FIG. 17 is a side elevation cut-away view of the existing slab drop-down member component of the present invention illustrating the manner of construction of its internal components.

A still further attachment for the present invention referred to as an existing slab drop-down member 152 is illustrated in FIGS. 16 and 17. The existing slab drop-down member 152 allows for the finishing of a concrete slab in a situation where it is desirable to construct a new concrete slab adjacent to an existing slab 154 with an upper surface that is slightly lower than that of the existing slab 154. This application is most common in the pouring of driveways up to an existing garage.

The existing slab drop-down member 152 is employed by attaching it to the non-powered end of a screed roller member 12. This attachment is accomplished in much the same manner as described above for other components of the present invention in that it contains an isolated bearing 88 and an outer bearing body 90. Additionally, the bearing 88 and outer bearing body 90 are isolated from the screed roller member 12 by the use of an isolation ring 92. Finally, the bearing 88 and outer bearing body 90 are attached to the existing slab drop-down member 152 by the use of a plurality of large bolts 124 that pass through the isolation ring 92 and the inner bearing spacer 158 and into the existing slab drop-down body 153. This allows for the attachment of a pull rope 22 on the non-powered end of the screed roller member 12 that provides a means of controlling this end of the present invention.

The existing slab drop-down member 152 has an extending drop-down body 153 that has an outside diameter that is smaller than that of the screed roller member 12. The drop-down body 153 allows the outer surface of the screed roller member 12 to operate at a level that is lower than the existing slab 154 thereby providing a means for finishing a concrete slab that is lower than the existing slab 154. Thus, the use of the existing slab drop-down member 152 in conjunction with the present invention creates the desired relationship between the two adjacent concrete slabs.

Figure 18:
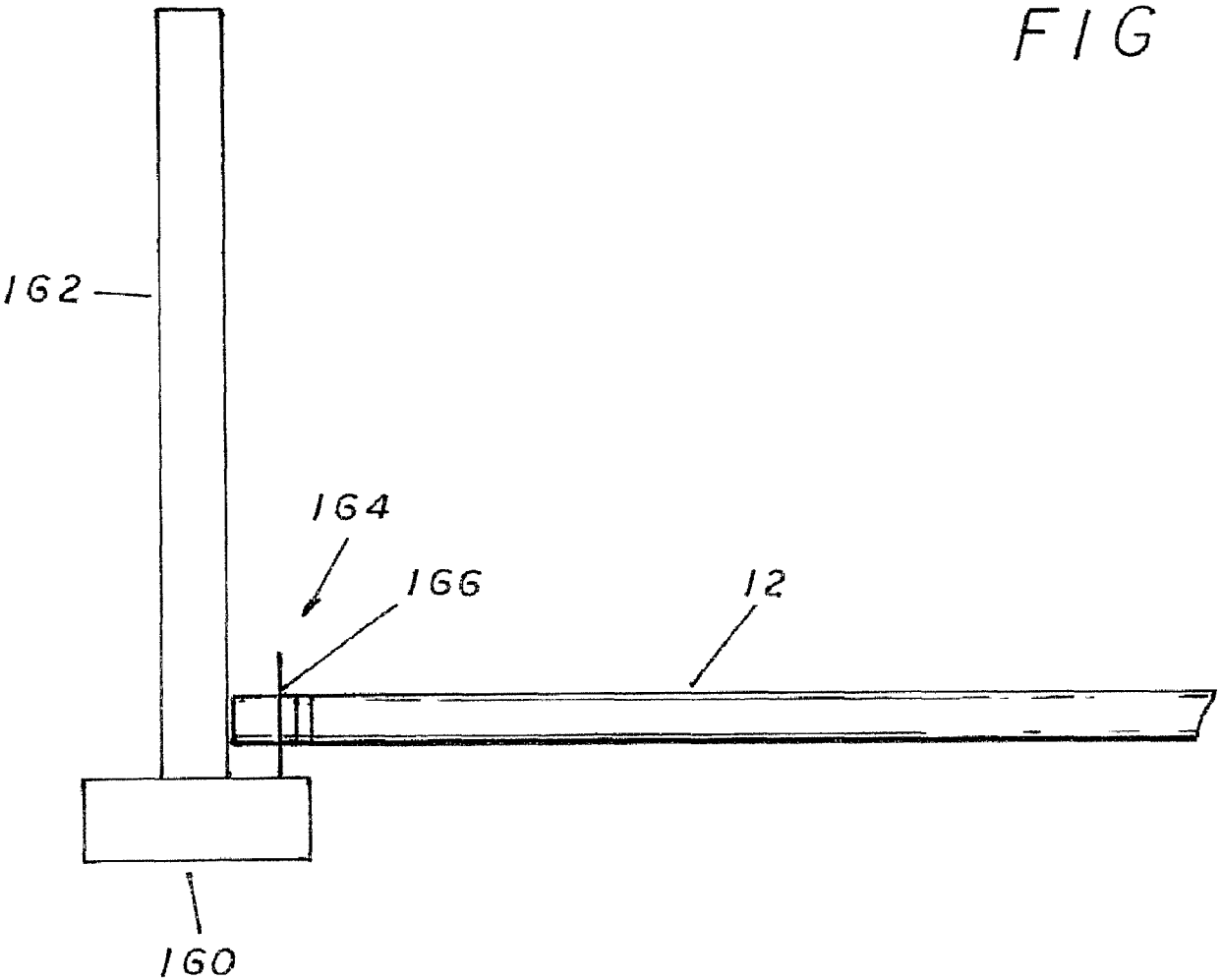
FIG. 18 is a front elevation view of the footing member component of the present invention illustrating its manner of construction.
Figure 19:
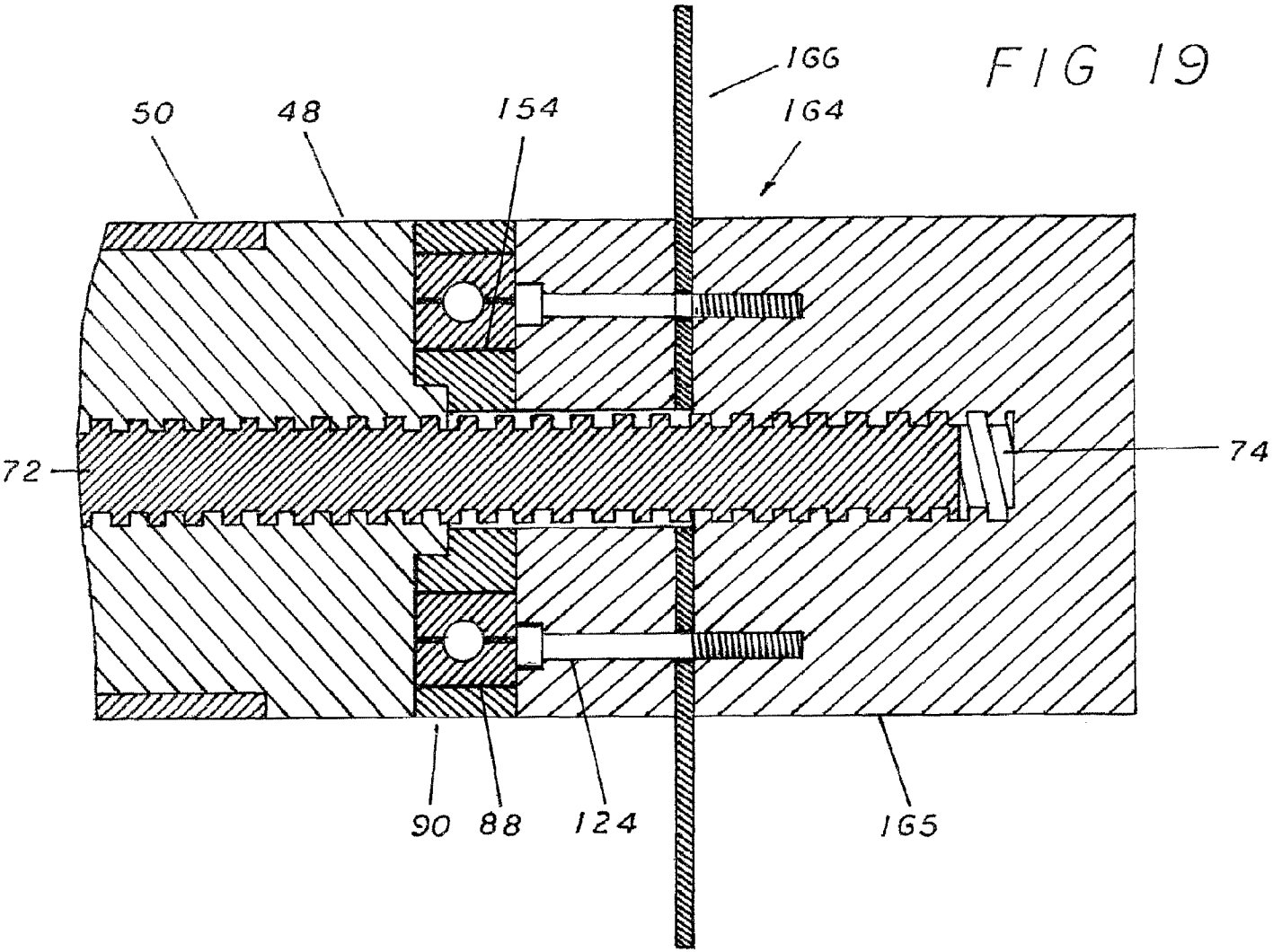
FIG. 19 is a side elevation cut-away view of the footing member component of the present invention illustrating the manner of construction of its internal components.
Figure 22:
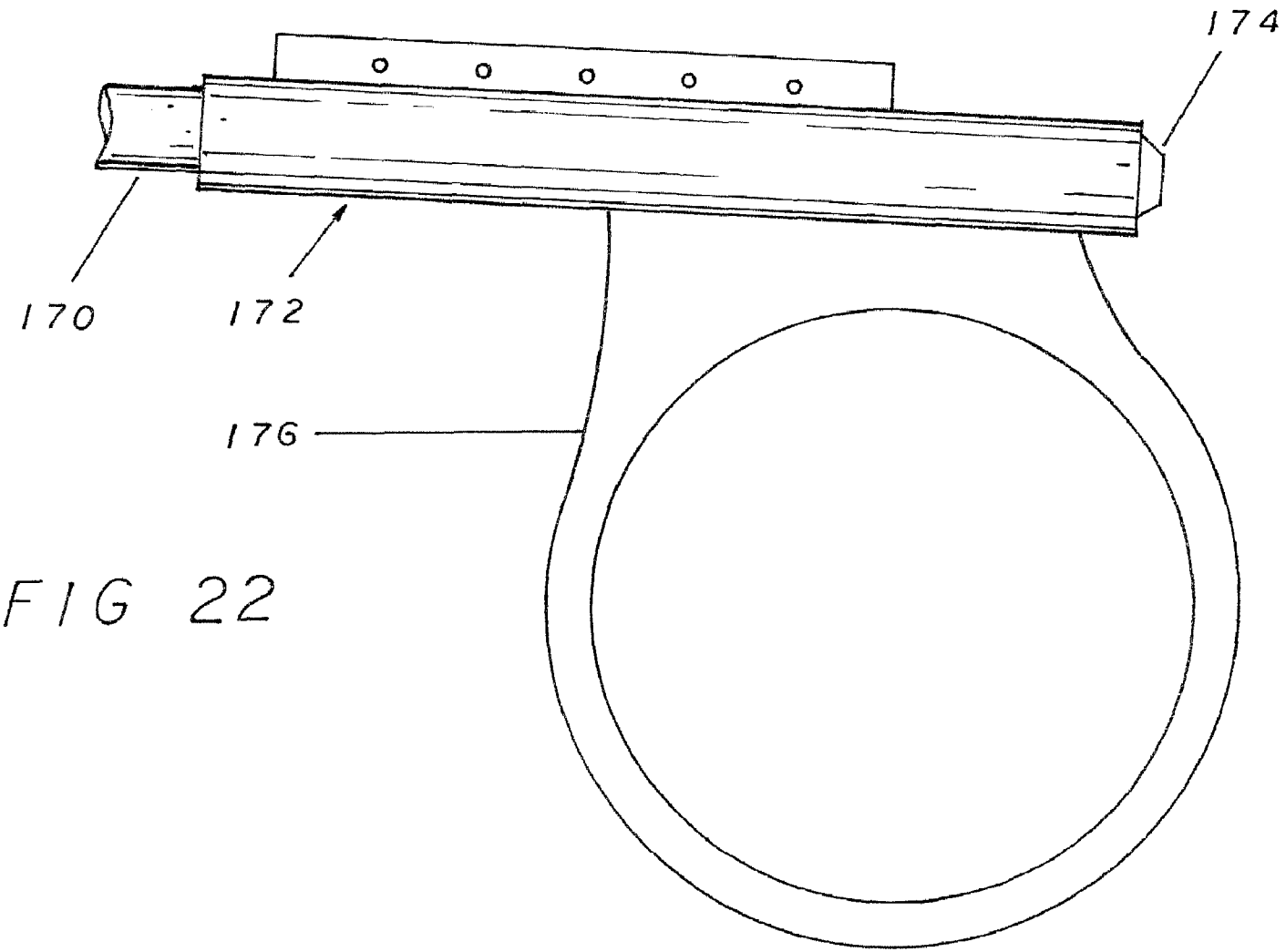
FIG. 22 is a side elevation view of the stinger body of the vibrational compacting member component of the present invention.
Figure 23:
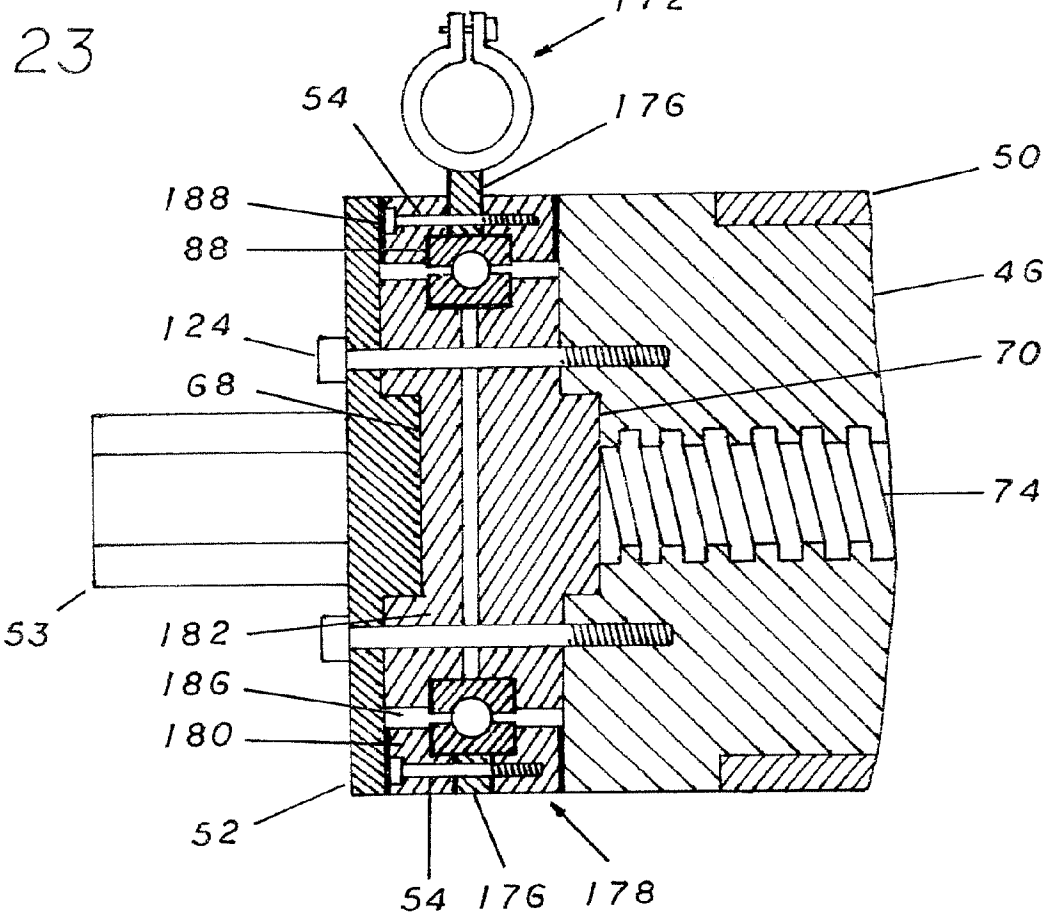
FIG. 23 is a side elevation cut-away view of the vibrational compacting member component of the present invention illustrating the manner of construction of its internal components.

A yet further attachment for the present invention is the footing member 164 and is illustrated in FIGS. 18 and 19. The footing member 164 provides the present invention with the Figures of finishing a concrete slab that is used to form the floor of a basement where the footings 160 and walls 162 are already built. The footing member 164 is made up of a footing member body 165 that is attached to the non-powered end of a screed roller member 12 in the same manner as described for the previous attachments using an outer bearing body 90 and bearing 88 configuration.

The footing member 164 is equipped with a ring spacer 166. The ring spacer 166 is a circular plate that is inserted between the footing member body 165 and the footing member spacer 163 in a location so that it effectively raises the screed roller member 12 up off of the footing 160. Additionally, the footing member spacer 163, the ring spacer 166, and the footing member body 165 are held together by the use of a plurality of large bolts 124. This design allows for the simplified pouring of such a concrete slab up to the wall 162 and over the footing 160 to properly construct a basement floor.

The final attachment for the present invention in terms of this discussion is the vibration compacting member 167 which is illustrated in FIGS. 20, 21, 22, and 23. The vibration compacting member 167 operates to enhance the present invention's concrete compacting effect on the unfinished concrete slab 16. This is accomplished by the employment of a device that is commonly used in the concrete industry known as a stinger 174. The stinger 174 is made up of a vibrating rod that is inserted into wet concrete and which drives out air pockets contained within the concrete.

In its use with the present invention, the stinger's 174 vibration drive motor 168 is attached to the drive assembly 20. The vibration drive motor 168 has a flexible drive rod 170 that extends from it down to the stinger body 172 positioned at the drive end of the screed roller member 12 between the drive plate assembly 52 and the tube body 50.

The attachment of the vibration compacting member 167 to the screed roller member 12 is accomplished by the use of a stinger bearing assembly 178 in a similar manner as described above for the present invention's other attachments. The stinger bearing assembly's 178 primary component is the stinger body 172 which is in turn made up of a stinger tube 173 and a stinger ring 176. The stinger body serves to contain the stinger 174 and transfer its vibrational motion to the stinger ring 176. The stinger ring 176 is in turn attached to the stinger bearing assembly 178 and this component transfers the vibration of the stinger 174 to the screed roller member 12. This design serves to impart a vibrational aspect to the motion of the screed roller member 12 during the finishing operation. This vibration has been found to enhance the compacting of the unfinished concrete 16 as it operates to drive off unwanted the air pockets that are inherent in all concrete pours.

The positioning of the bearing 88 within the stinger bearing assembly 178 is accomplished by the use of the outer and inner housings, 180 and 182. As previously stated, the stinger bearing assembly 178 is positioned between the drive plate assembly 52 and the screed roller member 12. The inner housing 182 contains a female recess 68 and a male shoulder 70 enabling it to lock into these components. Additionally, the inner housing 182 is secured to the screed female attachment plug 46 of the screed roller member 12 by a plurality of large bolts 124. Finally, the inner housing is constructed to have a bearing housing 184 centrally located on its outer surface. The bearing housing 184 provides a mechanism that allows the bearing 88 to be fitted within it.

The outer housing 180 provides the means for the securement of the stinger ring 176 and all of the other components attached to it. This is accomplished by the inner housing being constructed of two halves that sandwich the stinger ring 176 and outer portion of the bearing 88. This sandwich is then held together by passing a plurality of bolts 54 through the assembled components. Additionally, when the outer housing 180 is properly positioned within the stinger bearing assembly 178, there is a remaining rotation gap 188 left between it and the drive plate assembly 52 and the screed roller member 12. The rotational gap 188 allows the stinger ring 176 and its related components and the bearing 88 to remain stationary while the drive plate assembly 52 and screed roller members 12 rotate. Finally, there is also a housing gap 186 left between the outer and inner housings, 180 and 182, for the same rotational purpose.

Although the present invention has been described in considerable detail with reference to certain preferred versions thereof, other versions are possible. Therefore, the spirit and scope of the appended claims should not be limited to the description of the preferred versions contained herein.

What is claimed:

1. A cement screed system, comprising:

a screed roller member comprising first and second screed rollers, along with an articulation member disposed between and interconnected with each of said first and second screed rollers, wherein said first and second screed rollers extend along first and second longitudinal axes, respectively, wherein said articulation member allows said first and second longitudinal axes to be disposed in non-collinear relation;

a drive assembly comprising a motor that is interconnected with said screed roller member and that rotationally powers said screed roller member;

a first handle assembly interconnected with said screed roller member on a side of said articulation member having said first screed roller, wherein a first pulling force exerted by an operator on said first handle assembly moves said screed roller member over a concrete pour in a direction that is opposite to a rotational direction of said screed roller member over the concrete pour when being screeded by said cement screed system; and a first pull bearing interconnected with said screed roller member on a side of said articulation member having said second screed roller.

2. The cement screed system of claim 1, wherein said articulation member comprises a U-joint.

3. The cement screed system of claim 2, wherein said articulation member further comprises a second pull bearing.

4. The cement screed system of claim 3, wherein said second pull bearing is disposed about said U-joint.

5. The cement screed system of claim 1, wherein said articulation member further comprises a second pull bearing.

6. A cement system comprising the cement screed system of claim 5, first and second forms disposed in spaced relation, a support disposed between said first and second forms, and a concrete pour contained between said first and second forms, wherein said second pull bearing interfaces with said support, wherein said screed roller member interfaces with each of said first and second forms, and wherein said articulation member allows an angle that said first longitudinal axis is disposed to be based upon a height of said support relative to a height of said first form and an angle that said second longitudinal axis is disposed to be based upon said height of said support relative to a height of said second form.

7. The cement screed system of claim 1, wherein said articulation member is threadably interconnected with each of said first and second screed rollers.

8. The cement screed system of claim 1, wherein said articulation member is detachably locked to each of said first and second screed rollers.

9. The cement screed system of claim 1, wherein an orientation of said first longitudinal axis relative to said second longitudinal axis is not fixed.

10. The cement screed system of claim 1, wherein a second pulling force may be exerted on said first pull bearing, and along with said first pulling force moves said screed roller member over the concrete pour when being screeded by said cement screed system.

11. The cement screed system of claim 1, further comprising a second handle attached to said first pull bearing, wherein said second handle is rotationally isolated from said screed roller member by said first pull bearing.

12. The cement screed system of claim 11, wherein said second handle comprises a pull rope.

* * * * *